US010780693B2

(12) United States Patent
Nitta

(10) Patent No.: US 10,780,693 B2
(45) Date of Patent: Sep. 22, 2020

(54) INKJET HEAD

(71) Applicant: Toshiba Tec Kabushiki Kaisha, Tokyo (JP)

(72) Inventor: Noboru Nitta, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/273,766

(22) Filed: Feb. 12, 2019

(65) Prior Publication Data

US 2019/0184700 A1 Jun. 20, 2019

Related U.S. Application Data

(62) Division of application No. 15/928,816, filed on Mar. 22, 2018, now abandoned.

(30) Foreign Application Priority Data

Mar. 24, 2017 (JP) ..... 2017-058661
Mar. 24, 2017 (JP) ..... 2017-058662

(51) Int. Cl.
*B41J 2/045* (2006.01)
*B41J 2/14* (2006.01)

(52) U.S. Cl.
CPC ..... *B41J 2/04595* (2013.01); *B41J 2/04541* (2013.01); *B41J 2/04581* (2013.01); *B41J 2/04588* (2013.01); *B41J 2/04596* (2013.01); *B41J 2/14209* (2013.01); *B41J 2202/12* (2013.01)

(58) Field of Classification Search
CPC ..... B41J 2/04581; B41J 2202/06
See application file for complete search history.

(56) References Cited

U.S. PATENT DOCUMENTS 6,328,395 B1 12/2001 Kitahara et al.
6,431,676 B2 * 8/2002 Asauchi ..... B41J 2/04541 347/10

(Continued)

FOREIGN PATENT DOCUMENTS

EP 0827838 A2 3/1998
EP 2361767 A1 8/2011
JP 5871851 B2 3/2016

OTHER PUBLICATIONS

Extended European Search Report dated Jul. 27, 2018, filed in counterpart European Patent Application No. 18163660.6, 8 pages.

(Continued)

*Primary Examiner* — Shelby L Fidler
(74) *Attorney, Agent, or Firm* — Kim & Stewart LLP

(57) ABSTRACT

According to one embodiment, an inkjet head includes a pressure chamber connected to a nozzle, an actuator corresponding to the pressure chamber and configured to change a volume of the pressure chamber, and a drive circuit configured to drive the actuator causing two or more ink droplets to be consecutively discharged from the nozzle. The drive circuit applies in sequence a first drive waveform for expanding the pressure chamber, a second drive waveform having a first pulse width, a third drive waveform for releasing the pressure chamber from an expanded state, a fourth drive waveform having a second pulse width, and a fifth drive waveform for contracting the pressure chamber.

6 Claims, 20 Drawing Sheets

(56) References Cited

U.S. PATENT DOCUMENTS

| | | | | |
|---|---|---|---|---|
| 7,950,758 | B2 | 5/2011 | Yoshida | |
| 8,427,115 | B2 | 4/2013 | Nitta | |
| 9,427,956 | B2 | 8/2016 | Nitta et al. | |
| 9,694,577 | B2 | 7/2017 | Nitta et al. | |
| 2002/0054311 | A1* | 5/2002 | Kubo | B41J 2/04581 358/1.13 |
| 2003/0067500 | A1 | 4/2003 | Fujimura et al. | |
| 2005/0083359 | A1* | 4/2005 | Tamura | B41J 2/04588 347/10 |
| 2013/0215172 | A1 | 8/2013 | Kaneko et al. | |
| 2014/0253619 | A1 | 9/2014 | Norigoe | |
| 2016/0167378 | A1* | 6/2016 | Kimura | B41J 2/04591 347/10 |
| 2017/0066236 | A1 | 3/2017 | Sohgawa et al. | |
| 2018/0272705 | A1 | 9/2018 | Ono et al. | |
| 2018/0319159 | A1* | 11/2018 | Klerken | B41J 2/04551 |

OTHER PUBLICATIONS

Chinese Office Action dated Nov. 29, 2019, mailed in counterpart Chinese Application No. 201810203137.5, 14 pages (with translation).

* cited by examiner

R = 0.28 Ω
C = 0.37 μF
L = 0.65 μH
e32 = 1.56 μS
e34 = 2.7 μS
e36 = 1.7 μS
e38 = 1.52 μS
e40 = 2.94 μS
e42 = 0.42 μS

R = 0.28 Ω
C = 0.37 μF
L = 0.65 μH e32 = 1.56 μS
e34 = 2.7 μS
e36 = 1.7 μS
e38 = 1.14 μS
e40 = 3.12 μS
e42 = 0.6 μS

R = 0.28 Ω
C = 0.37 μF
L = 0.65 μH e32 = 1.56 μS
e34 = 2.6 μS
e36 = 2.24 μS
e38 = 1.22 μS
e40 = 2.84 μS
e42 = 0.54 μS

R = 0.33 Ω
C = 0.37 μF
L = 0.65 μH e22 = 1.56 μS
e24 = 2.8 μS
e26 = 3.1 μS
e28 = 0.76 μS

INKJET HEAD

CROSS-REFERENCE TO RELATED APPLICATIONS

This application is a division of U.S. patent application Ser. No. 15/928,816, filed Mar. 22, 2018, which is based upon and claims the benefit of priority from Japanese Patent Application No. 2017-058661, filed on Mar. 24, 2017 and Japanese Patent Application No. 2017-058662, filed on Mar. 24, 2017, the entire contents of each of which are incorporated herein by reference.

FIELD

Embodiments described herein relate generally to an inkjet head.

BACKGROUND

In an inkjet head that can discharge multiple droplets from a single nozzle, the number of droplets discharged is adjusted when gradation-type printing is being performed. In the multi-drop printing method in the related art, a drive waveform for discharging a single ink droplet from the nozzle is repeated as many times as necessary to provide the desired total number of droplets. Therefore, as the number of ink droplets is increased, the number of operations of an actuator is also increased, and, as a result, power consumption is increased. In addition, in general, since an operating time increases in direct proportion to the number of ink droplets that are discharged, there is a problem in that it is difficult to increase a drive frequency.

For this reason, there is a demand for an inkjet head providing reduced power consumption when discharging multiple ink droplets from a nozzle in a multi-drop printing method, while still being capable of providing high-speed operation.

DETAILED DESCRIPTION

In general, according to one embodiment, an inkjet head includes a pressure chamber connected to a nozzle, an actuator corresponding to the pressure chamber and configured to change a volume of the pressure chamber, and a drive circuit configured to drive the actuator causing two or more ink droplets to be consecutively discharged from the nozzle. The drive circuit applies in sequence a first drive waveform for expanding the pressure chamber, a second drive waveform having a first pulse width, a third drive waveform for releasing the pressure chamber from an expanded state, a fourth drive waveform having a second pulse width, and a fifth drive waveform for contracting the pressure chamber.

Hereinafter, embodiments of inkjet head that can reduce power consumption and increase an operation speed by discharging multiple ink droplets will be described with reference to the drawings.

First, the configuration of an inkjet head 1 will be described with reference to FIGS. 1 to 6.

Figure 1:
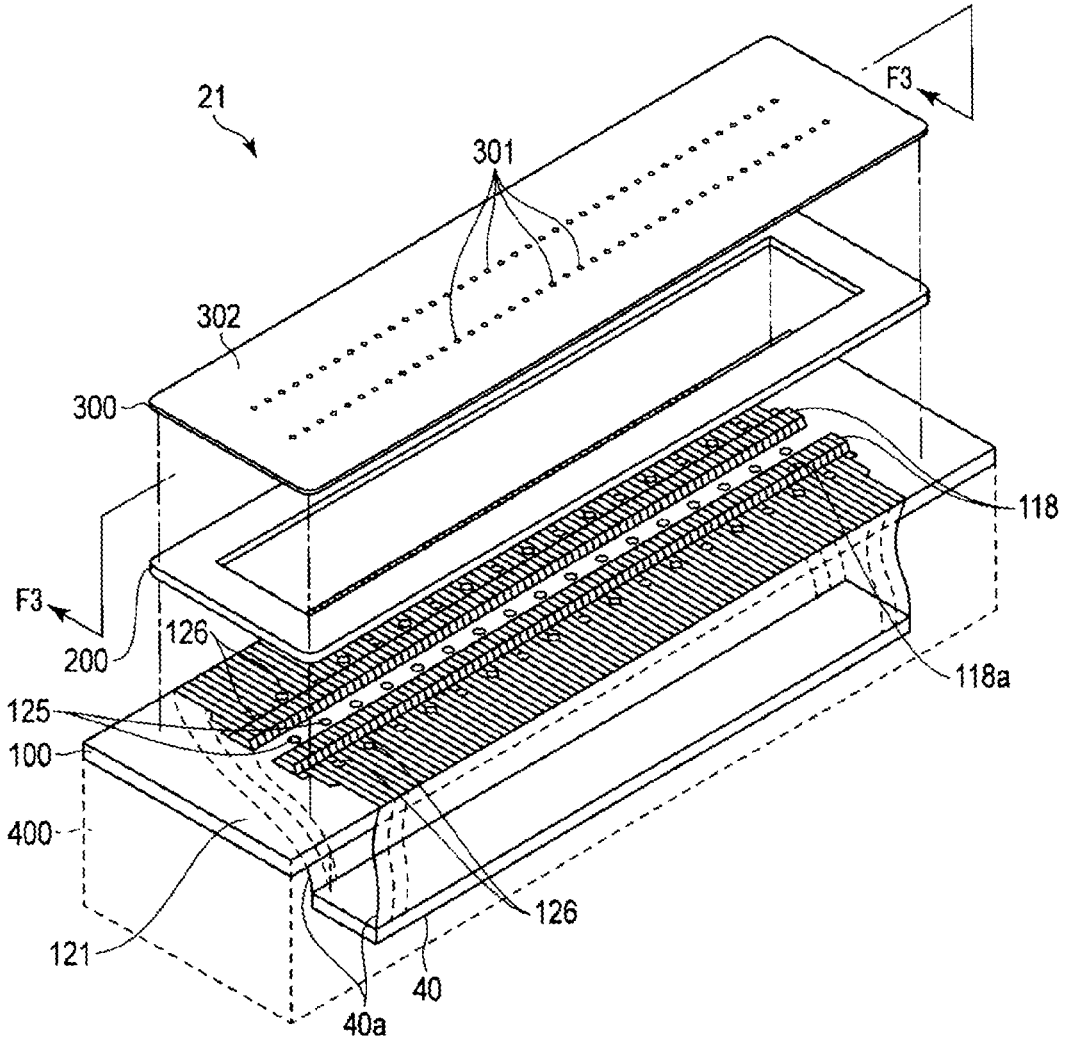
FIG. 1 is an exploded perspective view of an inkjet head.

FIG. 1 is an exploded perspective view of the inkjet head 1. For example, the inkjet head 1 is an on-demand type inkjet head using a share mode method. For example, the inkjet head is mounted in an inkjet printer and discharges ink to a recording medium.

The inkjet head 1 has a substrate 100, a frame 200, a nozzle plate 300, and a casing 400. Further, the inkjet head has upstream and downstream side ink manifolds (not specifically illustrated), a drive circuit 40, and the like in the casing 400. The drive circuit 40 operates the inkjet head 1. The upstream and downstream side ink manifolds are connected to upstream and downstream side ink tanks (not specifically illustrated) outside the head 1.

The substrate 100 is a rectangular shaped plate, and one surface of the substrate 100 is a mounting surface 121. The inkjet head 1 has two lines of piezoelectric members 118, which extend in the longitudinal direction of the substrate 100 and are arranged in two rows in a central portion of the mounting surface 121. Each of the piezoelectric members 118 has a trapezoidal cross section in a transverse direction, and the piezoelectric members 118 are disposed in parallel and spaced apart from each other. The substrate 100 includes a multiple supply ports 125 and multiple discharge ports 126 arranged in the longitudinal direction of the piezoelectric members 118.

The supply ports 125 are arranged between the two piezoelectric members 118 in the longitudinal direction of the substrate 100 along the central portion of the substrate 100. Each of the supply ports 125 penetrates the substrate 100 and is in fluid communication with an upstream side ink manifold, and an end of the supply port 125 is connected to the upstream side ink tank. In other words, the ink, which is supplied to the inkjet head 1 from the upstream side ink tank through the upstream side ink manifold and the supply ports 125, flows into an ink chamber 116 (see FIGS. 5 and 6). The discharge ports 126 are arranged in two rows outside of the two piezoelectric members 118 with the supply ports 125 interposed therebetween. Each of the discharge ports 126 penetrates the substrate 100 and is in fluid communication with a downstream side ink manifold, and an end of the discharge port 126 is connected to the downstream side ink tank. The ink in the ink chamber 116 is discharged to the downstream side ink tank via the respective discharge ports 126 and the downstream side ink manifold. The ink in the downstream side ink tank disposed outside the head 1 returns back to the upstream side ink tank by a pump (not specifically illustrated). Therefore, the ink is circulated between the respective ink tanks and the ink chamber 116 via the supply ports 125 and the discharge ports 126.

The nozzle plate 300 is a rectangular plate shape, and has multiple nozzles 301 for discharging ink droplets. The nozzles 301 penetrate the nozzle plate 300 and are arranged in two rows in the longitudinal direction of the nozzle plate 300. An ink repellent film is formed on a surface 302 of the nozzle plate 300 on a side from which the ink droplets are discharged from the nozzles 301. For example, the ink repellent film is made of a silicon-based liquid repellent material or a fluorine-containing organic material that has liquid repellency.

The nozzle plate 300 is disposed to face the mounting surface 121 of the substrate 100 via the frame 200. With this arrangement, the inkjet head 1 forms the ink chamber 116 surrounded by the substrate 100, the frame 200, and the nozzle plate 300.

The frame 200 is disposed between the mounting surface 121 of the substrate 100 and the nozzle plate 300. The frame 200 has a size that surrounds the two piezoelectric members 118 and surrounds all of the nozzles 301.

The piezoelectric members 118 are formed of lead zirconate titanate (PZT). The piezoelectric members 118 are formed by sticking two plate-shaped piezoelectric bodies together such that polarization directions thereof are opposite to each other. In the example embodiment described herein, the piezoelectric members 118 are bar-shaped extending in the longitudinal direction. Further, the piezoelectric material is not limited to lead zirconate titanate (PZT), and for example, various types of piezoelectric materials such as PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, and AlN may be used.

The piezoelectric members 118 are attached to the mounting surface 121 of the substrate 100. For example, a thermosetting epoxy-based adhesive is used as an adhesive.

Figure 2:
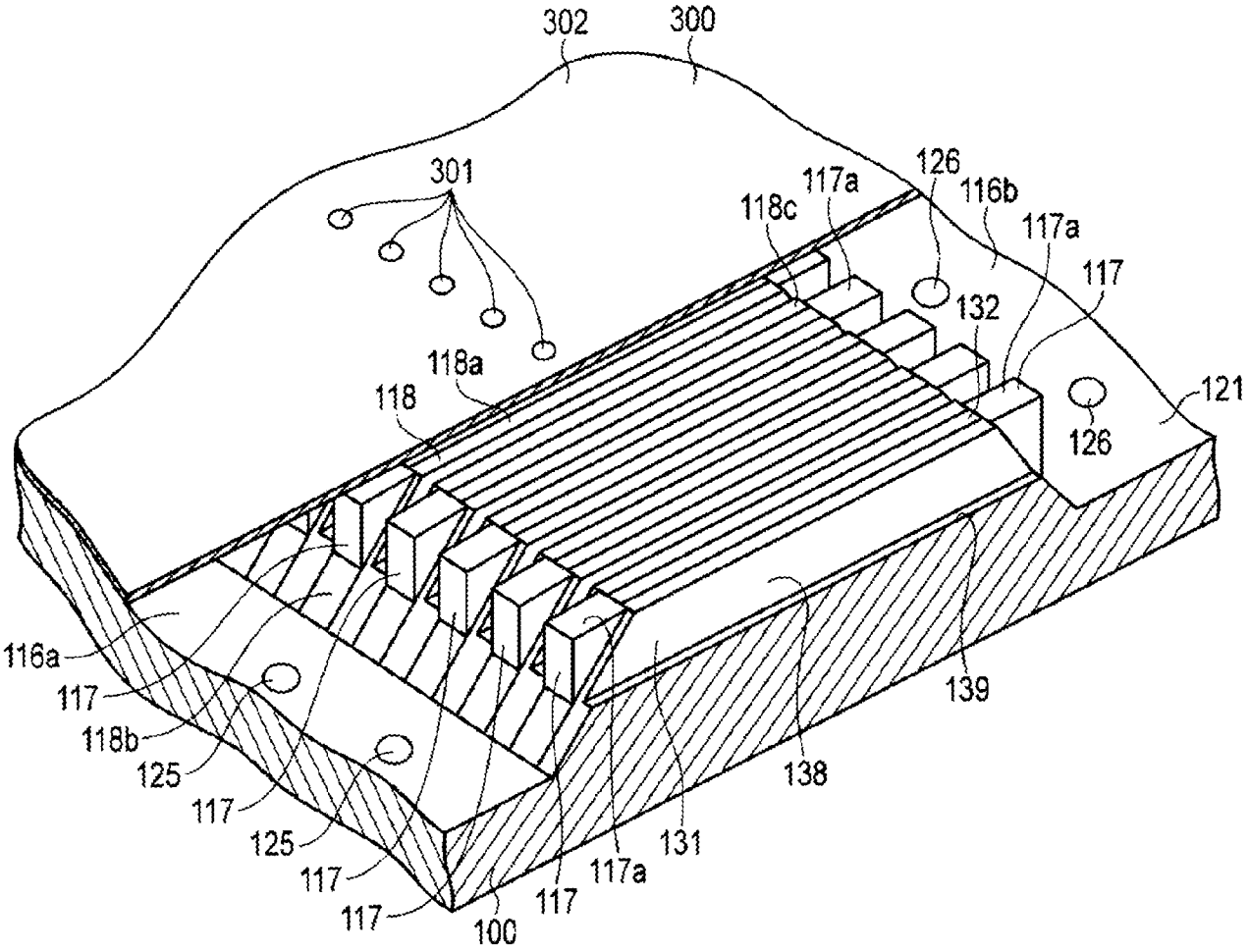
FIG. 2 is a partial enlarged perspective view of one of piezoelectric members arranged in two rows on a substrate of an inkjet head.

FIG. 2 is a partially enlarged perspective view one of piezoelectric members 118 arranged in two rows on the substrate 100. A portion of the nozzle plate 300 is not illustrated in FIG. 2 to show an internal structure of the piezoelectric member 118.

The piezoelectric member 118 has an upper surface 118*c* and two inclined surfaces 118*b*. The upper surface 118*c* extends in the transverse direction of the substrate 100 in parallel with the mounting surface 121 of the substrate 100. The two inclined surfaces 118*b* extend toward the mounting surface 121 from either end sides of the upper surface 118*c*. Multiple first grooves 131 (hereinafter, also referred to as pressure chambers 131) and multiple second grooves 132 (hereinafter, also referred to as dummy chambers 132), which extend in the transverse direction of the substrate 100, are alternately provided on a surface 118*a* of the piezoelectric member 118. That is, the piezoelectric member 118 has partition walls 133 which separate the first grooves 131 and the second grooves 132. In other words, each partition wall 133 is a protrusion portion between adjacent first and second grooves 131 and 132. The opposite ends of the first grooves 131 and the opposite ends of the second grooves 132 are connected to the inclined surfaces 118*b*. In the example embodiment described herein, the first grooves 131 and the second grooves 132 are formed in the same shape. However, the shapes of the first grooves 131 and the second grooves 132 may be different from each other in other examples.

Wall materials 117 are provided at the both end portions of the second grooves 132, respectively. The wall materials 117 seal the opposite ends of the second grooves 132. Each of the wall materials 117 has an upper surface 117*a* provided to be flush with the upper surface 118*c* of the piezoelectric member 118. The upper surface 118*c* of the piezoelectric member 118 and the upper surfaces 117*a* of the wall materials 117 are attached to the nozzle plate 300. Therefore, the ink in the ink chamber 116, is prevented from penetrating into the second grooves 132.

Figure 3:
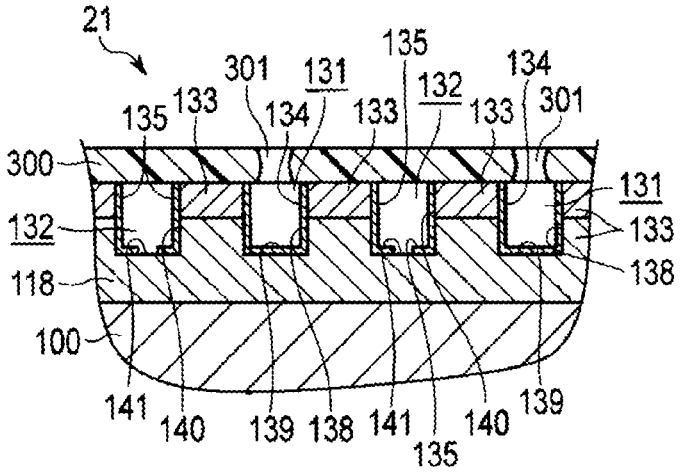
FIG. 3 is a partial enlarged cross-sectional view of an inkjet head taken along arrow line F3-F3 in FIG. 1 in a longitudinal direction.
Figure 4:
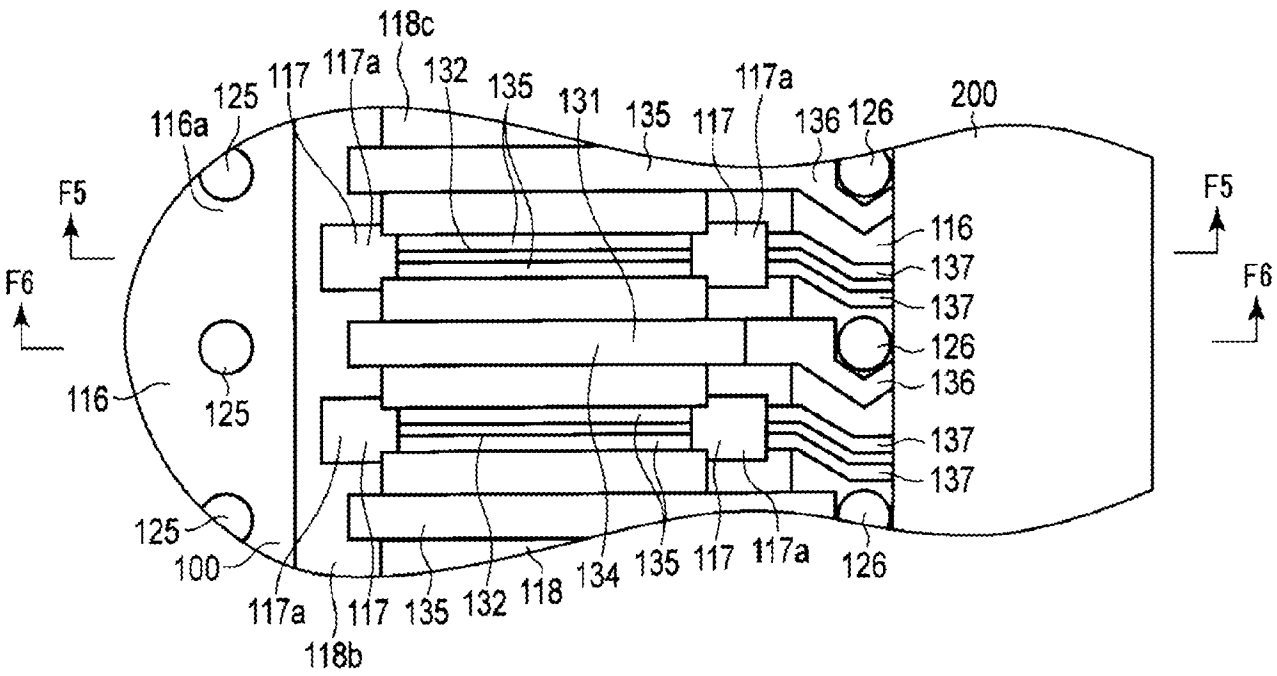
FIG. 4 is a partial enlarged top plan view of one of the piezoelectric members of in inkjet head.
Figure 5:
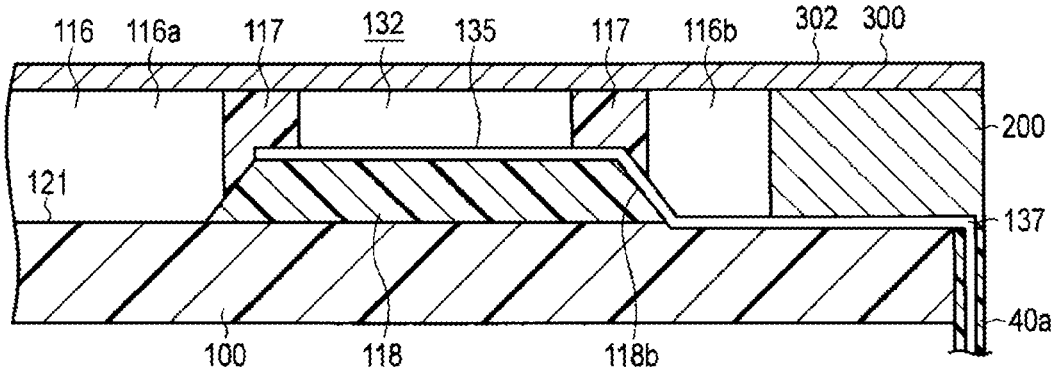
FIG. 5 is a cross-sectional view of the inkjet head taken along arrow line F5-F5 in FIG. 4.
Figure 6:
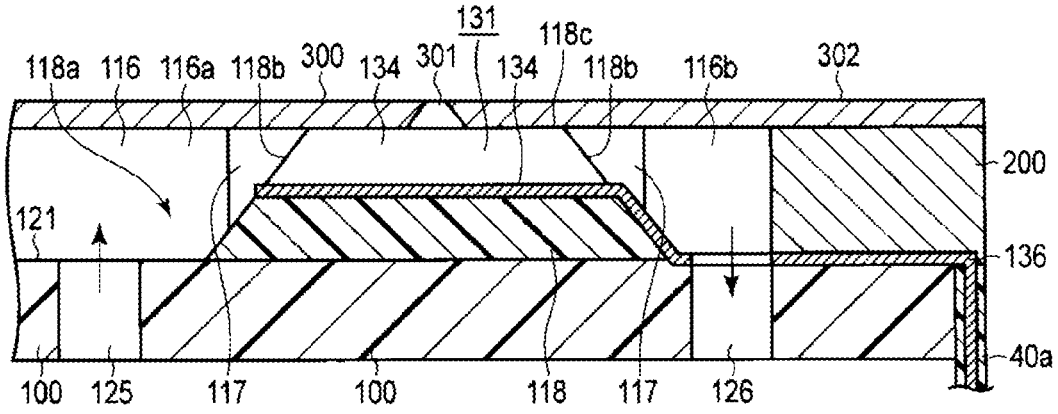
FIG. 6 is a cross-sectional view of the inkjet head taken along arrow line F6-F6 in FIG. 4.

FIG. 3 is a partially enlarged cross-sectional view of the inkjet head 1 illustrated in FIG. 1 taken along arrow line F3-F3 in the longitudinal direction. FIG. 4 is a partially enlarged top plan view of the piezoelectric member 118 of the inkjet head 1 illustrated in FIG. 1. FIG. 5 is a cross-sectional view of the inkjet head 1 illustrated in FIG. 4 taken along arrow line F5-F5. FIG. 6 is a cross-sectional view of the inkjet head 1 illustrated in FIG. 4 taken along arrow line F6-F6. Hereinafter, a structure of the ink chamber 116 and a method of causing the ink to flow will be described in detail with reference to FIGS. 3 to 6.

First, as illustrated in FIG. 3, the nozzles 301 of the nozzle plate 300 are provided such that one nozzle 301 communicates with one first groove 131. That is, the nozzle plate 300 has the two rows of nozzles 301 corresponding to the first grooves 131 formed in the two rows of piezoelectric members 118. There is no nozzle that corresponds to the second grooves 132.

As illustrated in FIGS. 5 and 6, the ink chamber 116 is a space surrounded by the mounting surface 121 of the substrate 100, the nozzle plate 300, and the frame 200. The ink chamber 116 includes a first ink chamber 116*a* and second ink chambers 116*b*. The first ink chamber 116*a* is a space between the two piezoelectric members 118. The supply ports 125 communicate with the first ink chamber 116*a*. The second ink chambers 116*b* are frame 200 side (outer) spaces of the two piezoelectric members 118. The discharge ports 126 communicate with the second ink chambers 116*b*, respectively.

The ink is supplied to the first ink chamber 116*a* via the upstream side ink manifold from the upstream side ink tank outside the head 1. The ink chamber 116 is slowly filled with the supplied ink. Specifically, the ink flowing into the first ink chamber 116*a* flows toward the two second ink chambers 116*b* outside the first ink chamber 116*a* via the first grooves 131 of the piezoelectric members 118 on the both sides of the first ink chamber 116*a*. Therefore, the entire ink chamber 116 surrounded by the frame 200 is filled with the ink. Further, the ink flowing into the second ink chamber 116*b* flows toward the downstream side ink tank in the outside of the head 1 via the downstream side ink manifold through the discharge ports 126.

The both ends of the second grooves 132, which is alternately disposed between the first grooves 131, are closed by the wall materials 117, as illustrated in FIGS. 4 and 5. Thus, the ink does not penetrate into the second grooves 132. As described above, the first grooves 131 serve as a part of a flow path through which the ink is circulated, and the second grooves 132 serve as dummy chambers into which no ink penetrates.

Next, electrodes and wires on the substrate 100 and the piezoelectric members 118 will be described.

As illustrated in FIG. 3, first electrodes 134 are formed in the first grooves 131, and second electrodes 135 are formed in the second grooves 132. In the example described in FIG. 3, one first electrode 134 is formed in one first groove 131, and two second electrodes 135 are formed in one second groove 132. Each first electrode 134 is formed over a pair of the side surfaces 138 and the bottom surface 139 of each first groove 131. Each second electrode 135 is formed over a side surface 140 and a part of the bottom surface 141 of each second groove 132.

As illustrated in FIGS. 4 to 6, first wires 136 extending to the first grooves 131 and second wires 137 extending to the second grooves 132 are provided on the substrate 100 in the second ink chambers 116*b*. In detail, one first wire 136 is provided for each first groove 131, and two second wires 137 are provided for each second groove 132. One end of the first wire 136 is connected to the first electrode 134 formed in the first groove 131, and the other end of the first wire 136 is connected to the drive circuit 40 illustrated in FIG. 1 via a flexible wiring board 40*a*. In addition, one end of each of the two second wires 137 is connected to each of the two second electrodes 135 formed in the second groove 132, and the other end of each of the second wires 137 is connected to the drive circuit 40 via the flexible wiring board 40*a*.

For example, the first and second electrodes 134 and 135 provided in the first and second grooves 131 and 132 are formed of a nickel thin film. The material of the first and second electrodes 134 and 135 is not limited thereto, and for example, the first and second electrodes 134 and 135 may be formed of a thin film made of Pt (platinum), Al (aluminum), or Ti (titanium). Further, other materials such as Cu (copper), Al (aluminum), Ag (silver), Ti (titanium), W (tungsten), Mo (molybdenum), and Au (gold) may be used as the material of the first and second electrodes 134 and 135.

With the aforementioned configuration, each piezoelectric member 118 may be deformed by a potential difference between the first electrode 134 and the second electrode 135 that faces the first electrode 134 with the piezoelectric member 118 interposed therebetween. That is, an actuator for varying the volume of the first groove 131 is configured with the piezoelectric member 118 and the first and second electrodes 134 and 135 with the piezoelectric member 118 interposed therebetween. Further, one channel for discharging the ink includes the actuator, the first groove 131 filled with the ink, and the nozzle 301 corresponding to the first groove 131.

In the following descriptions, the first groove 131 will be referred to as a pressure chamber 131, and the second groove 132 will be referred to as a dummy chamber 132. The drive circuit 40 of the inkjet head 1 will be described with reference to FIG. 7.

Figure 7:
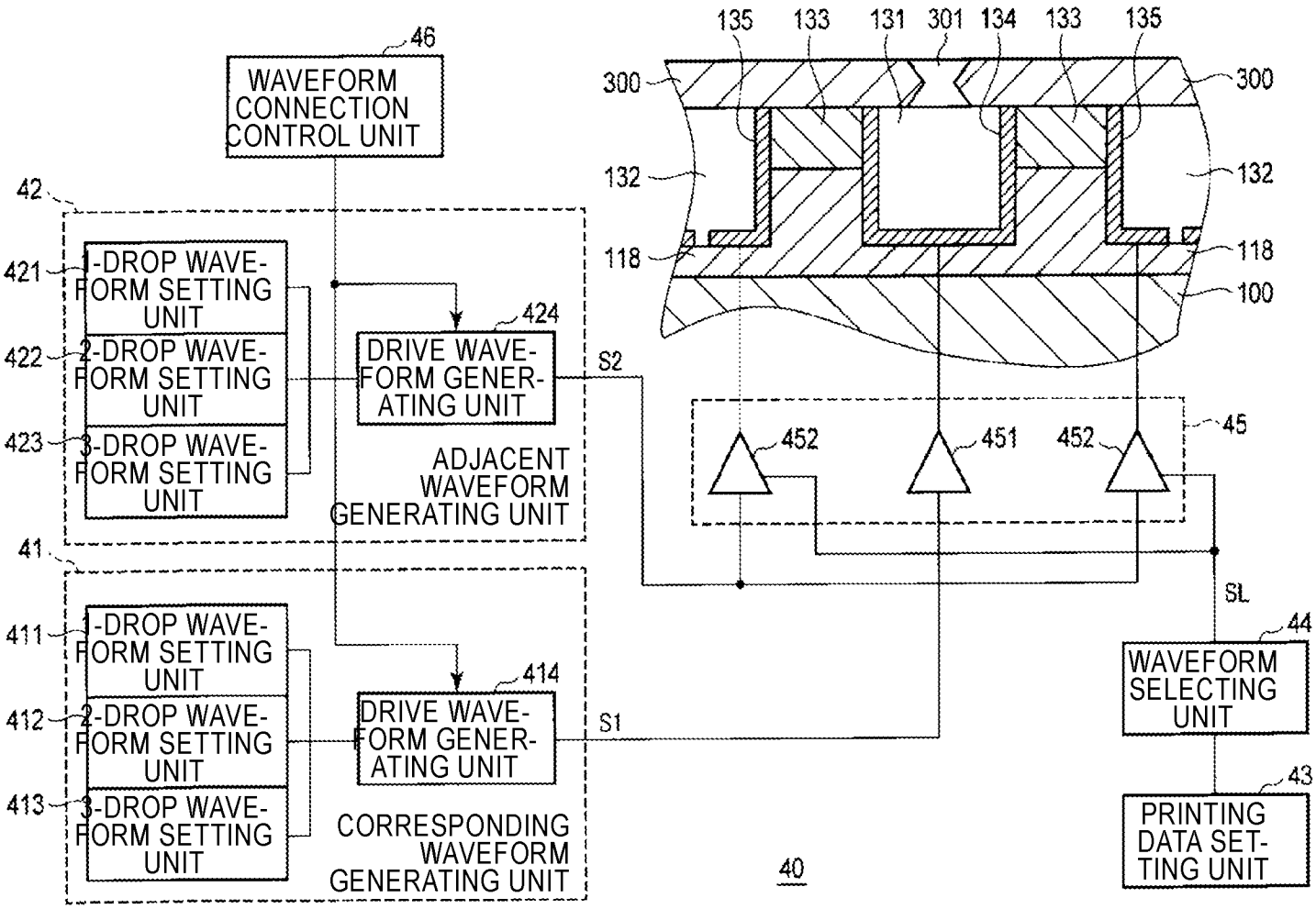
FIG. 7 is a block diagram of a drive circuit of an inkjet head.

FIG. 7 is a block diagram of a main part of the drive circuit 40 together with a partially enlarged view of the inkjet head 1. In the inkjet head 1, the two dummy chambers 132, which are adjacent to the partition walls 133 of one pressure chamber 131, are partially illustrated. As described above, the volume of the pressure chamber 131 is changed by the actuator such that the ink can be discharged from the nozzle 301 that communicates with the pressure chamber 131. The actuator, which is a combination of the partition walls 133, causes the piezoelectric member 118 to undergo shear deformation by a potential difference between the first electrode 134 in the pressure chamber 131 and the second electrodes 135 in the adjacent dummy chambers 132, thereby expanding or contracting the volume of the pressure chamber 131.

The drive circuit 40 is a circuit for applying a driving signal of the actuator to the first and second electrodes 134 and 135. The drive circuit 40 includes a corresponding waveform generating unit 41, an adjacent waveform generating unit 42, a printing data setting unit 43, a waveform selecting unit 44, a driver unit 45, and a waveform connection control unit 46.

The waveform generating unit 41 generates a signal S1 to be applied to the first electrode 134. The waveform generating unit 42 generates a signal S2 to be applied to the second electrodes 135 in the two dummy chambers 132 adjacent to the pressure chamber 131.

The printing data setting unit 43 sets external printing data provided from the outside. The waveform selecting unit 44 outputs an ON/OFF selecting signal SL based on the printing data set by the printing data setting unit 43. An ON time of the selecting signal SL varies depending on a gradation value of the printing data (see FIGS. 22A to 22C and FIGS. 23A to 23C).

The driver unit 45 has a first driver 451 connected to the first electrode 134, and second drivers 452 connected to the second electrodes 135. The first driver 451 is interposed between the waveform generating unit 41 and the first electrode 134. The first driver 451 applies the signal S1, which is generated by the waveform generating unit 41, to the first electrode 134. Each of the second drivers 452 is interposed between the waveform generating unit 42 and the second electrodes 135. Each of the second drivers 452 has a floating (high impedance) control input terminal, and the selecting signal SL is input to the floating control input terminal. When the selecting signal SL is ON, the second drivers 452 apply the signal S2, which is generated by the waveform generating unit 42, to the second electrodes 135. When the selecting signal SL is OFF, the second drivers 452 bring the output into the OFF state, and do not apply the signal S2, which is generated by the waveform generating unit 42, to the second electrodes 135.

The waveform generating unit 41 and the waveform generating unit 42 have a 1-drop waveform setting unit 411 and 421, a 2-drop waveform setting unit 412 and 422, a 3-drop waveform setting unit 413 and 423, and a drive waveform generating unit 414 and 424, respectively.

In the waveform generating unit 41, the 1-drop waveform setting unit 411 sets drive waveform data for the first electrode 134 for discharging one ink droplet from the nozzle 301. The 2-drop waveform setting unit 412 sets drive waveform data for the first electrode 134 for continuously discharging two ink droplets from the nozzle 301. The 3-drop waveform setting unit 413 sets drive waveform data for the first electrode 134 for continuously discharging three ink droplets from the nozzle 301.

In the waveform generating unit 42, the 1-drop waveform setting unit 421 sets drive waveform data for the second electrodes 135 for discharging one ink droplet from the nozzle 301. The 2-drop waveform setting unit 422 sets drive waveform data for the second electrodes 135 for continuously discharging two ink droplets from the nozzle 301. The 3-drop waveform setting unit 423 sets drive waveform data for the second electrodes 135 for continuously discharging three ink droplets from the nozzle 301.

Hereinafter, the drive waveform data set by the respective waveform setting units 411, 421, 412, 422, 413, and 423 will be referred to as drive waveform units.

In the waveform generating unit 41, the drive waveform generating unit 414 selects and connects, in the predetermined order, the drive waveform units set by the respective waveform setting units 411, 412, and 413. Further, the drive waveform generating unit 414 outputs the drive waveform signal S1 for the first electrode 134, to which the drive waveform units are connected, to the first driver 451 of the driver unit 45.

In the waveform generating unit 42, the drive waveform generating unit 424 selects and connects, in the predetermined order, the drive waveform units set by the respective waveform setting units 421, 422, and 423. Further, the drive waveform generating unit 424 outputs the drive waveform signal S2 for the second electrode 135, to which the drive waveform units are connected, to the second driver 452 of the driver unit 45.

The order in which the drive waveform generating units 414 and 424 select the drive waveform units is controlled by the waveform connection control unit 46. That is, the waveform connection control unit 46 sets the order for connecting the waveform setting units 411, 421, 412, 422, 413, and 423, and controls the drive waveform generating units 414 and 424 such that waveform units are connected based on the setting.

Here, the drive waveform unit selected by the drive waveform generating unit 414 corresponds to the drive waveform unit simultaneously selected by the drive waveform generating unit 424. That is, when the drive waveform generating unit 414 selects the drive waveform unit for the 1-drop waveform setting unit 411, the drive waveform generating unit 424 also selects the drive waveform unit for the 1-drop waveform setting unit 421. When the drive waveform generating unit 414 selects the drive waveform unit for the 2-drop waveform setting unit 412, the drive waveform generating unit 424 also selects the drive waveform unit for the 2-drop waveform setting unit 422. When the drive waveform generating unit 414 selects the drive waveform unit for the 3-drop waveform setting unit 413, the drive waveform generating unit 424 also selects the drive waveform unit for the 3-drop waveform setting unit 423. The connection order may be programmable.

As described above, while the selecting signal SL is ON, the drive waveform signal S1 is applied to the first electrode 134, and the drive waveform signal S2 is applied to the second electrodes 135. As such, the actuator is operated by differential voltage between the drive waveform signal S1 and the drive waveform signal S2. While the selecting signal SL is OFF, the drive waveform signal S1 is applied to the first electrode 134, but the drive waveform signal S2 is not applied to the second electrodes 135, and the second electrodes 135 are brought into a floating state. Therefore, electric potential of the second electrodes 135 follows the electric potential of the first electrode 134 which is induced as the capacitance of the actuator. As a result, no potential difference occurs between the first electrode 134 and the second electrodes 135 such that the actuator is not operated.

Next, the drive waveform units providing a 1-drop waveform, a 2-drop waveform, and a 3-drop waveform will be described with reference to FIGS. 8 to 13.

Figure 8:
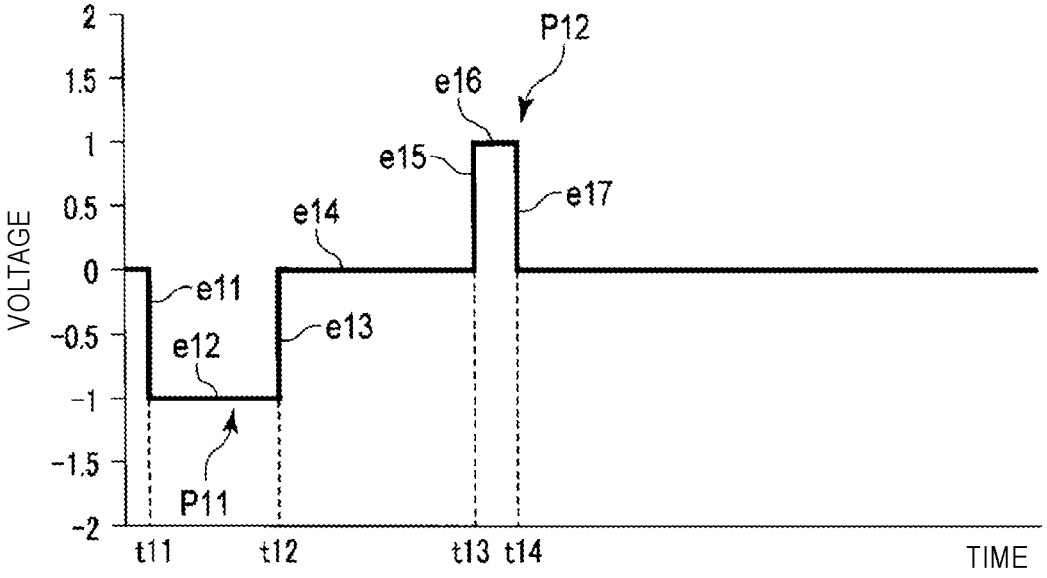
FIG. 8 depicts a drive voltage of a 1-drop waveform applied to an actuator of an inkjet head.

FIG. 8 depicts a drive voltage of a 1-drop waveform to be applied to the actuator. The drive voltage of the 1-drop waveform is a differential voltage between the drive waveform unit set to the 1-drop waveform setting unit 411 of the waveform generating unit 41 and the drive waveform unit set to the 1-drop waveform setting unit 421 of the waveform generating unit 42. That is, the drive waveform units for generating the differential voltage illustrated in FIG. 8 are set to the 1-drop waveform setting unit 411 and the 1-drop waveform setting unit 421, respectively. As the drive voltage is applied to the actuator, one ink droplet is discharged from the nozzle 301. This drive voltage waveform will be referred to as a 1-drop waveform.

Figure 9:
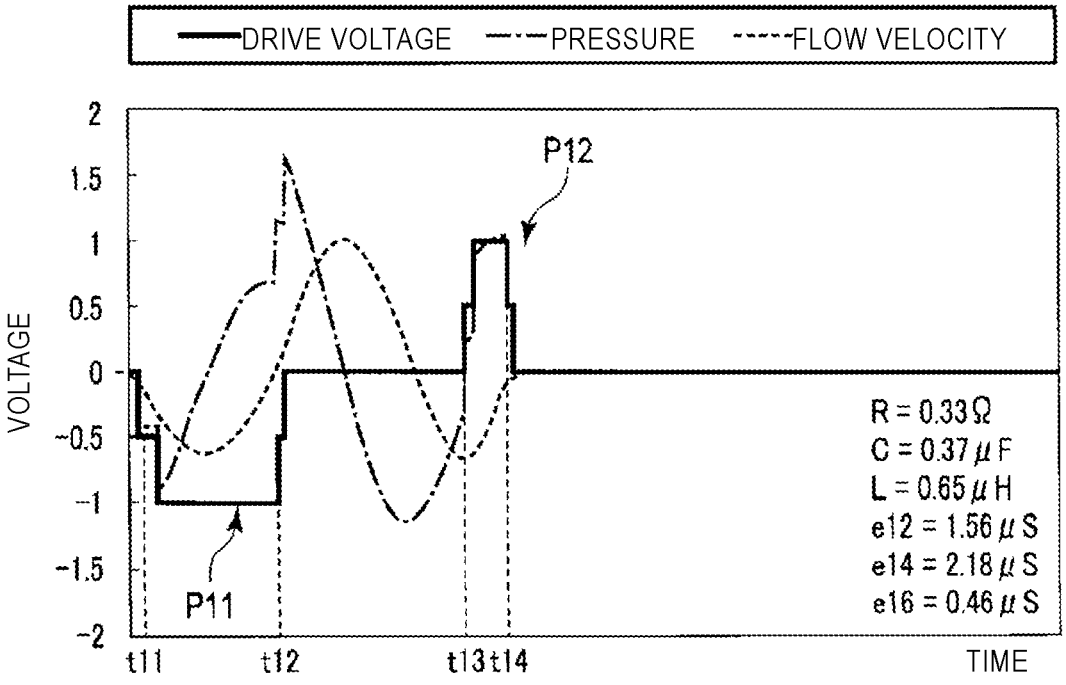
FIG. 9 depicts a drive voltage of a 1-drop waveform and simulated values of an ink pressure waveform and an ink flow velocity waveform under an application of the 1-drop waveform to an actuator of an inkjet head.
Figure 16:
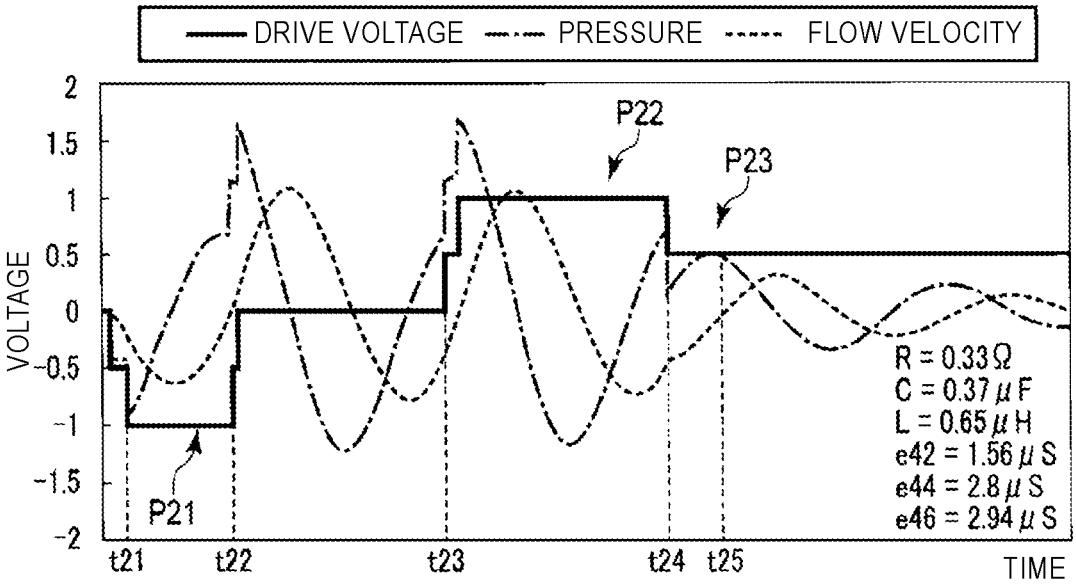
FIG. 16 is a first waveform chart for explaining a method of determining a trailing edge of a contraction pulse and a trailing edge of a weak contraction pulse of the 2-drop waveform.
Figure 17:
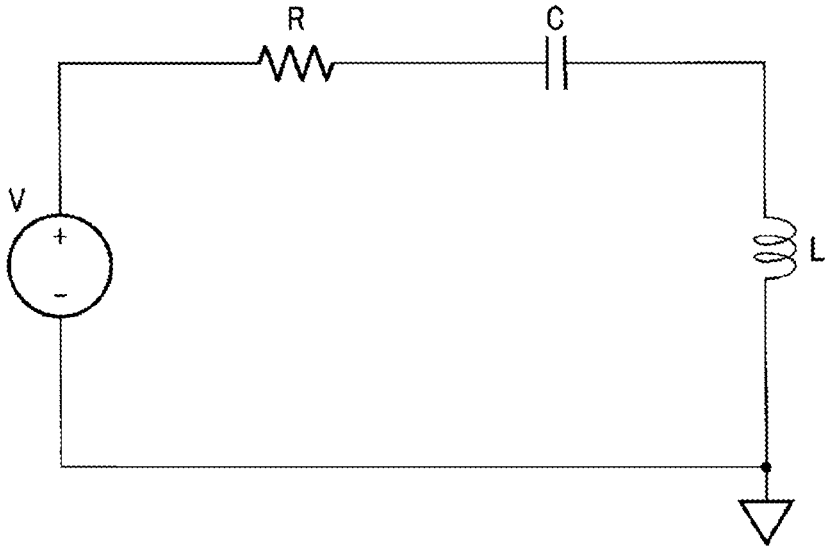
FIG. 17 depicts a circuit diagram having parameters used for the simulated values in FIGS. 9, 11, 13, 15, 16, 18, 19, 24, 25, 26, 27, and 28.

FIG. 9 depicts the drive voltage of the 1-drop waveform and simulated values of an ink pressure and an ink flow velocity under an application of the 1-drop waveform to the actuator, using the equivalent circuit illustrated in FIG. 17. The values R, C, and L illustrated in FIG. 9 correspond to the values R, C, and L of the equivalent circuit illustrated in FIG. 17. An electrical current flow in the equivalent circuit in FIG. 17 corresponds to an ink flow velocity in the vicinity of the pressure chamber 131 of the inkjet head 1. A voltage across the inductor L in the equivalent circuit in FIG. 17 corresponds to an ink pressure in the pressure chamber 131 in the vicinity of the nozzle 301. This correspondence to the equivalent circuit in FIG. 17 also applies to FIGS. 11, 13, 15, 16, 18, 19, 24, 25, 26, 27, and 28. In FIG. 9, the drive voltage waveform is indicated by the solid line, the ink pressure waveform is indicated by the dot dashed line, and the ink flow velocity waveform is indicated by the dashed line. In addition, values on a vertical axis are arbitrarily normalized values.

As illustrated in FIG. 8, the 1-drop waveform includes first to seventh waveform elements e11 to e17. The first waveform element e11 expands the volume of the pressure chamber 131 and provides negative pressure to the pressure chamber 131 at time t11. The second waveform element e12 generates a first standby time (t12-t11) that starts after the first waveform element e11. The third waveform element e13 returns the volume of the pressure chamber 131 to an original state and provides positive pressure to the pressure chamber 131 at time t12 after the first standby time elapses. The fourth waveform element e14 generates a second standby time (t13-t12) that starts after the third waveform element e13. The fifth waveform element e15 contracts the volume of the pressure chamber 131 and provides positive pressure to the pressure chamber 131 at time t13 after the second standby time elapses. The sixth waveform element e16 generates a third standby time (t14-t13) that starts after the fifth waveform element e15. The seventh waveform element e17 returns the volume of the pressure chamber 131 to the original state at time t14 after the third standby time elapses.

A combination of the first waveform element e11, the second waveform element e12, and the third waveform element e13 forms an expansion pulse P11 that returns the volume of the pressure chamber 131 to the original state after expanding the volume of the pressure chamber 131. That is, the first waveform element e11 corresponds to a leading edge of the expansion pulse P11, the second waveform element e12 corresponds to a pulse width of the expansion pulse P11, and the third waveform element e13 corresponds to a trailing edge of the expansion pulse P11. A combination of the fifth waveform element e15, the sixth waveform element e16, and the seventh waveform element e17 forms a contraction pulse P12 that returns the volume of the pressure chamber 131 to the original state after contracting the volume of the pressure chamber 131. That is, the fifth waveform element e15 corresponds to a leading edge of the contraction pulse P12, the sixth waveform element e16 corresponds to a pulse width of the contraction pulse P12, and the seventh waveform element e17 corresponds to a trailing edge of the contraction pulse P12.

At time t11 when the waveform element e11 is applied, that is at the leading edge of the expansion pulse P11, the partition walls 133 on the both sides are displaced to expand the volume of the pressure chamber 131. With this displacement, negative pressure is instantaneously applied to the ink in the pressure chamber 131, as illustrated in FIG. 9. As a result, a meniscus of the ink in the nozzle 301 is retracted.

Thereafter, the ink pressure is changed from negative to positive in accordance with natural pressure vibration of the ink in the pressure chamber. Further, when the first standby time, during which the waveform element e12 is applied, has elapsed at time t12, that is at the trailing edge of the expansion pulse P11 when the waveform element e13 is applied, the volume of the pressure chamber 131 returns to the original state. As illustrated in FIG. 9, positive pressure is instantaneously applied to the ink. As described above, when positive pressure is instantaneously applied to the ink by a pulse change in a state in which the ink pressure is positive pressure equal to or higher than a threshold value, the meniscus begins to be advanced and one ink droplet is discharged from the nozzle 301. That is, the first standby time is a time for waiting until the ink pressure increases from negative pressure at the leading edge of the expansion pulse P11 to the threshold value. The threshold value is a threshold pressure at which one ink droplet can be discharged by the instantaneous application of positive pressure to the ink at the trailing edge of the expansion pulse P11. For most efficient ink discharge, the first standby time, that is the duration of the waveform element e12, is set to be ½ of a natural pressure vibration period of the ink in the pressure chamber.

Thereafter, the ink pressure is changed from positive to negative in accordance with natural pressure vibration of the ink in the pressure chamber. When the ink pressure is changed to negative, the meniscus is retracted following the ink pressure change. Further, when the second standby time, during which the waveform element e14 is applied, has elapsed at time t13, that is at the leading edge of the contraction pulse P12 when the waveform element e15 is applied, the partition walls 133 on the both sides are displaced to contract the volume of the pressure chamber 131. With this displacement, positive pressure is instantaneously applied to the ink. However, no ink droplet is discharged from the nozzle 301 because the ink pressure is negative at time t13 at which positive pressure is applied.

In a state in which the volume of the pressure chamber 131 is contracted, when the third standby time, during which the waveform element e16 is applied, has elapsed at time t14, that is at the trailing edge of the contraction pulse P12 when the waveform element e17 is applied, the volume of the pressure chamber 131 returns to the original state. At this time t14, a magnitude of amplitude of pressure vibration of the ink is equal to negative pressure instantaneously applied to the ink at the trailing edge of the contraction pulse P12, and the ink flow velocity is zero. Therefore, residual vibration in the pressure chamber 131 is cancelled thereafter. That is, the second standby time and the third standby time are timed such that the residual vibration in the pressure chamber 131 is cancelled at the trailing edge of the contraction pulse P12.

As described above, as the drive voltage of the 1-drop waveform illustrated in FIG. 8 is applied to the actuator, the pressure chamber 131 is operated in the order of expansion, return, contraction, and return. Further, with the operations of expansion and return, one ink droplet is discharged from the nozzle 301 that communicates with the pressure chamber 131. In addition, with the subsequent operations of contraction and return, residual vibration is cancelled after the ink droplet is discharged.

Figure 10:
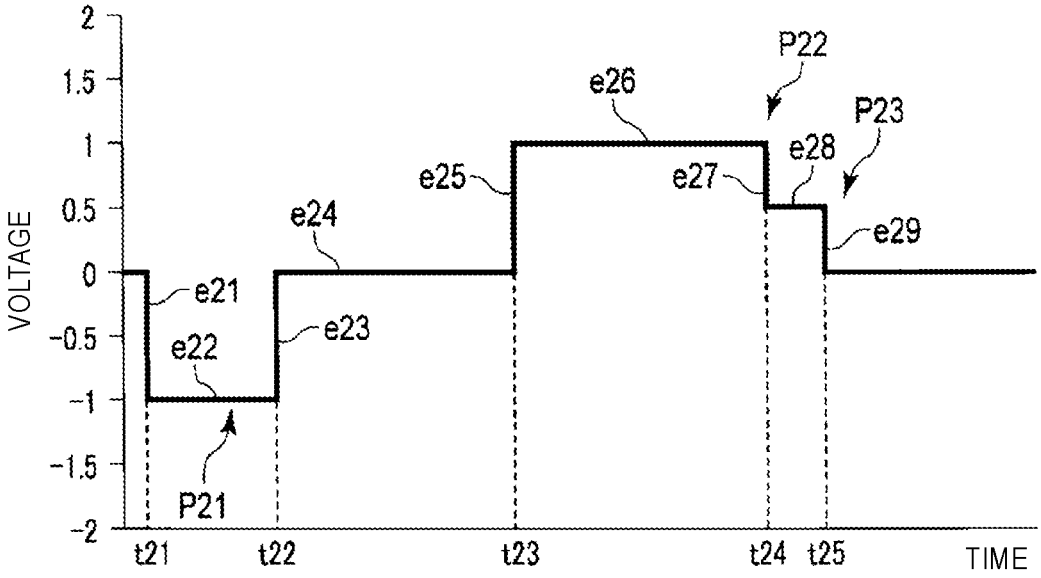
FIG. 10 depicts a drive voltage a 2-drop waveform applied to an actuator of an inkjet head.

FIG. 10 depicts a drive voltage of a 2-drop waveform to be applied to the actuator. The drive voltage of the 2-drop waveform is a differential voltage between the drive waveform unit set to the 2-drop waveform setting unit 412 of the waveform generating unit 41 and the drive waveform unit set to the 2-drop waveform setting unit 422 of the waveform generating unit 42. That is, the drive waveform units for generating the differential voltage illustrated in FIG. 10 are set to the 2-drop waveform setting unit 412 and the 2-drop waveform setting unit 422, respectively. The differential voltage is the drive voltage of the actuator. As the drive voltage is applied to the actuator, two ink droplets are consecutively discharged from the nozzle 301. This drive voltage waveform will be referred to as a 2-drop waveform.

Figure 11:
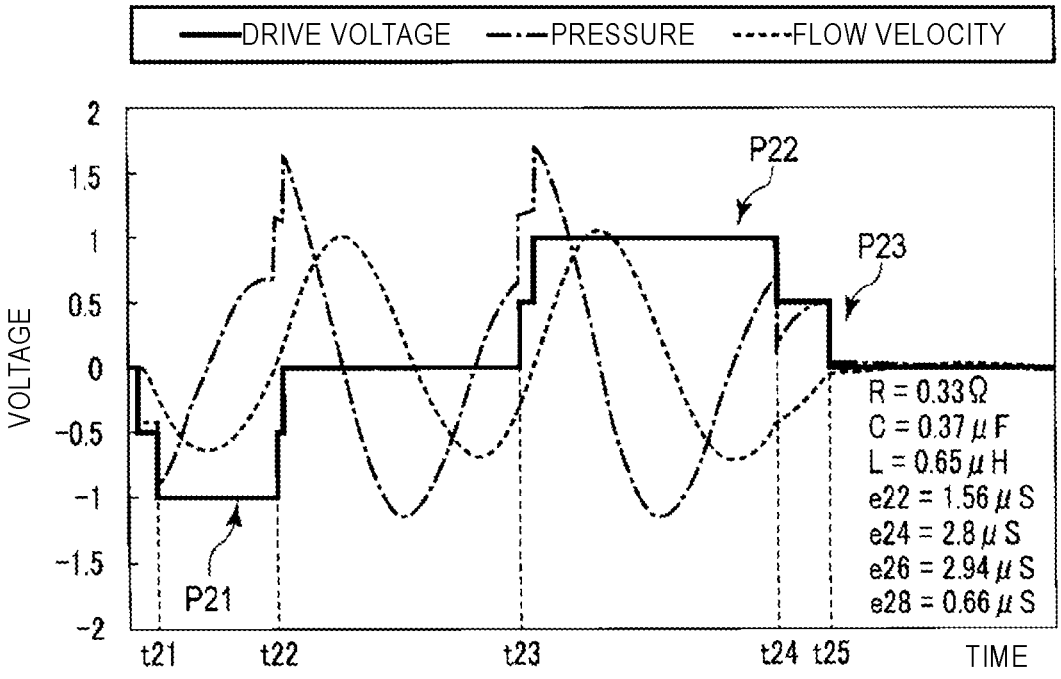
FIG. 11 depicts a drive voltage of a 2-drop waveform and simulated values of an ink pressure waveform and an ink flow velocity waveform under an application of the 2-drop waveform to an actuator of an inkjet head.

FIG. 11 depicts the drive voltage of the 2-drop waveform and simulated values of an ink pressure and an ink flow velocity under an application of the 2-drop waveform to the actuator. In FIG. 11, the drive voltage waveform is indicated by the solid line, the ink pressure waveform is indicated by the dot dashed line, and the ink flow velocity waveform is indicated by the dashed line. In addition, values on a vertical axis are arbitrarily normalized.

As illustrated in FIG. 10, the 2-drop waveform includes first to ninth waveform elements e21 to e29. The first waveform element e21 expands the volume of the pressure chamber 131 and provides negative pressure to the pressure chamber 131 at time t21. The second waveform element e22 generates a first standby time (t22-t21) that starts after the first waveform element e21. The third waveform element e23 returns the volume of the pressure chamber 131 to an original state and provides positive pressure to the pressure chamber 131 at time t22 after the first standby time elapses. The fourth waveform element e24 generates a second standby time (t23-t22) that starts after the third waveform element e23. The fifth waveform element e25 contracts the volume of the pressure chamber 131 and provides positive pressure to the pressure chamber 131 at time t23 after the second standby time elapses. The sixth waveform element e26 generates a third standby time (t24-t23) that starts after the fifth waveform element e25. The seventh waveform element e27 slightly returns the volume of the pressure chamber 131 at time t24 after the third standby time elapses. In the example illustrated in FIG. 11, assuming that a contraction percentage by the waveform element e25 is 100%, the volume of the pressure chamber 131 returns such that a contraction percentage becomes 50%. The eighth waveform element e28 generates a fourth standby time (t25-t24) that starts after the seventh waveform element e27. The ninth waveform element e29 returns the volume of the pressure chamber 131 to the original state at time t25 after the fourth standby time elapses.

A combination of the first waveform element e21, the second waveform element e22, and the third waveform element e23 forms an expansion pulse P21 that returns the volume of the pressure chamber 131 to the original state after expanding the volume of the pressure chamber 131. That is, the first waveform element e21 corresponds to a leading edge of the expansion pulse P21, the second waveform element e22 corresponds to a pulse width of the expansion pulse P21, and the third waveform element e23 is a trailing edge of the expansion pulse P21. A combination of the fifth waveform element e25, the sixth waveform element e26, and the seventh waveform element e27 forms a contraction pulse P22 that partially returns the volume of the pressure chamber 131 after the contracting of the volume of the pressure chamber 131, thereby bringing the pressure chamber 131 into a weak contraction state in which the pressure chamber 131 is contracted less than in the contraction state maintained by the sixth waveform element e26. That is, the fifth waveform element e25 corresponds to a leading edge of the contraction pulse P22, the sixth waveform element e26 corresponds to a pulse width of the contraction pulse P22, and the seventh waveform element e27 corresponds to a trailing edge of the contraction pulse P22. A combination of the eighth waveform element e28 and the ninth waveform element e29 forms a weak contraction pulse P23 that returns the pressure chamber 131 to the original state after maintaining the weak contraction state for a predetermined time. That is, the eighth waveform element e28 corresponds to a pulse width of the weak contraction pulse P23, and the ninth waveform element e29 corresponds to a trailing edge of the weak contraction pulse P23.

At time t21 when the waveform element e21 is applied, that is at the leading edge of the expansion pulse P21, the partition walls 133 on the both sides are displaced to expand the volume of the pressure chamber 131. With this displacement, negative pressure is applied to the ink in the pressure chamber 131, as illustrated in FIG. 11. As a result, a meniscus of the ink in the nozzle 301 is retracted.

Thereafter, the ink pressure is changed from negative to positive in accordance with natural pressure vibration of the ink in the pressure chamber. Further, when the first standby time, during which the waveform element e22 is applied, has elapsed at time t22, that is at the trailing edge of the expansion pulse P21 when the waveform element e23 is applied, the volume of the pressure chamber 131 returns to the original state. As illustrated in FIG. 11, positive pressure is instantaneously applied to the ink. As described above, when positive pressure is instantaneously applied to the ink by a pulse change in a state in which the ink pressure is positive pressure equal to or higher than a threshold value, the meniscus begins to be advanced and a first ink droplet is discharged from the nozzle 301. That is, the first standby time is a time for waiting until the ink pressure increases from negative pressure at the leading edge of the expansion pulse P21 to the threshold value. The threshold value is a threshold pressure at which one ink droplet can be discharged by the instantaneous application of positive pressure to the ink at the trailing edge of the expansion pulse P21. In the example illustrated in FIG. 11, the first standby time is ½ of the natural pressure vibration period of the ink in the pressure chamber.

Thereafter, the ink pressure is changed from positive to negative in accordance with natural pressure vibration of the ink in the pressure chamber. When the ink pressure is changed to negative, the meniscus is retracted following the ink pressure change. Thereafter, the ink pressure is changed back to positive pressure. Further, when the second standby time, during which the waveform element e24 is applied, has elapsed at time t23, that is at the leading edge of the contraction pulse P22 when the waveform element e25 is applied, the partition walls 133 on the both sides are displaced to contract the volume of the pressure chamber 131. With this displacement, positive pressure is instantaneously applied to the ink. Here, time t23 is a time at which the ink pressure becomes substantially the same value as that at time t22. Therefore, as positive pressure is instantaneously applied to the ink by a pulse change in a state in which the ink pressure is positive pressure equal to or higher than a threshold value, the meniscus begins to be advanced and a second ink droplet is discharged from the nozzle 301. That is, the second standby time is a time for waiting until the ink pressure increases to a pressure at which the second ink droplet can be discharged by the instantaneous application of positive pressure to the ink at the leading edge of the contraction pulse P22.

In a state in which the volume of the pressure chamber 131 is contracted, when the third standby time, during which the waveform element e26 is applied, has elapsed time t24, that is at the trailing edge of the contraction pulse P22 when waveform element e27 is applied, the partition walls 133 on the both sides are displaced so that the volume of the pressure chamber 131 returns slightly. With this displacement, the pressure chamber 131 is brought into a weak contraction state weaker than the contraction state. The weak contraction state is maintained until the fourth standby time, during which the waveform element e28 is applied, has elapsed. Further, at time t25 of the trailing edge of the weak contraction pulse P23 when the waveform element e29 is applied, the volume of the pressure chamber 131 returns to the original state. At time t25, a magnitude of amplitude of vibration of the ink pressure is equal to negative pressure applied to the ink by the trailing edge of the weak contraction pulse P23, and the ink flow velocity is zero. Therefore, residual vibration in the pressure chamber 131 is cancelled thereafter. That is, the third standby time and the fourth standby time are timed such that the residual vibration in the pressure chamber 131 is cancelled by the trailing edge of the weak contraction pulse P23.

As described above, as the drive voltage of the 2-drop waveform illustrated in FIG. 10 is applied to the actuator, the pressure chamber 131 is operated in the order of expansion, return, contraction, weak contraction, and return. Further, with the first operations of expansion and return, a first ink droplet is discharged from the nozzle 301 that communicates with the pressure chamber 131. In addition, with the subsequent operation of contraction, a second ink droplet is discharged from the nozzle 301. Further, with the subsequent operations of weak contraction and return, residual vibration is cancelled after the second ink droplet is discharged.

Figure 12:
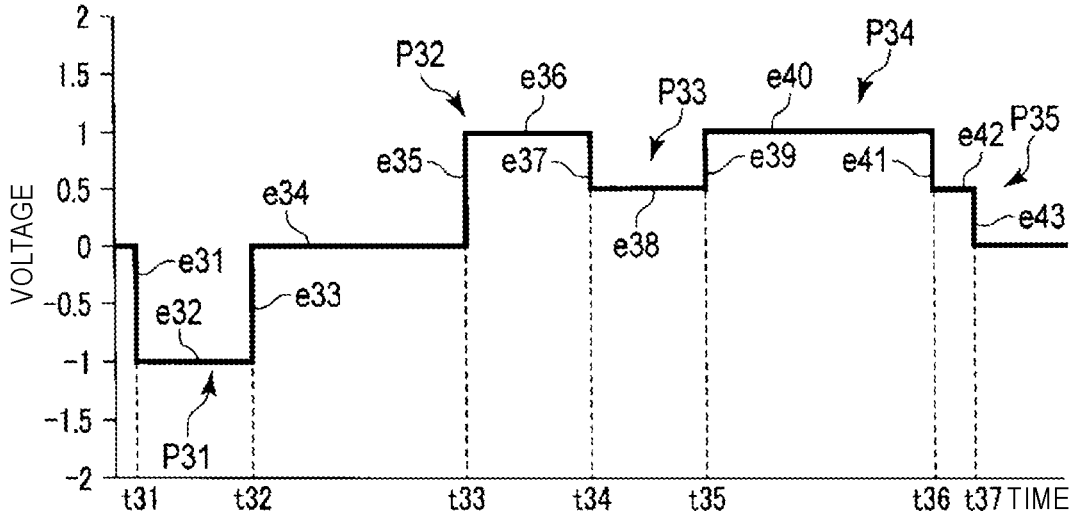
FIG. 12 depicts a drive voltage of a 3-drop waveform applied to an actuator of an inkjet head.

FIG. 12 depicts a drive voltage of a 3-drop waveform to be applied to the actuator. The drive voltage of the 3-drop waveform is a voltage between the drive waveform unit set to the 3-drop waveform setting unit 413 of the waveform generating unit 41 and the drive waveform unit set to the 3-drop waveform setting unit 423 of the waveform generating unit 42. That is, the drive waveform units for generating differential voltage illustrated in FIG. 12 are set to the 3-drop waveform setting unit 413 and the 3-drop waveform setting unit 423, respectively. The differential voltage is the drive voltage of the actuator. As the drive voltage is applied to the actuator, three ink droplets are consecutively discharged by from the nozzle 301. This drive voltage waveform will be referred to as a 3-drop waveform.

Figure 13:
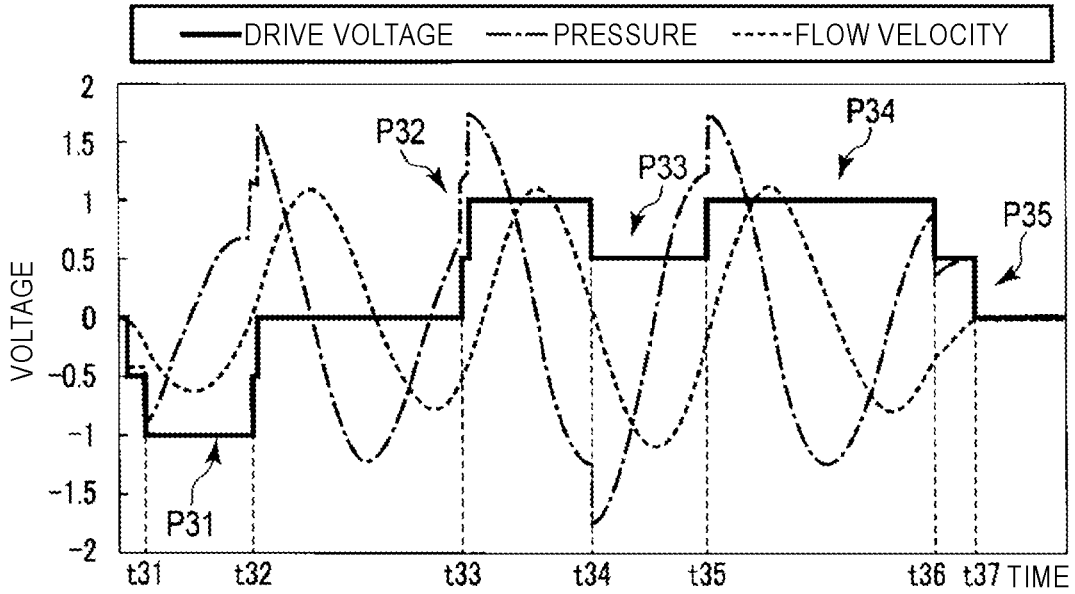
FIG. 13 depicts a drive voltage of a 3-drop waveform and simulated values of an ink pressure waveform and an ink flow velocity waveform under an application of the 3-drop waveform to an actuator of an inkjet head.

FIG. 13 depicts the drive voltage of the 3-drop waveform and simulated values of an ink pressure and an ink flow velocity under an application of the 3-drop waveform to the actuator. In FIG. 13, the drive voltage waveform is indicated by the solid line, the ink pressure waveform is indicated by the dot dashed line, and the ink flow velocity waveform is indicated by the dashed line. In addition, values on a vertical axis are arbitrarily normalized.

As illustrated in FIG. 12, the 3-drop waveform includes first to thirteenth waveform elements e31 to e43. The first waveform element e31 expands the volume of the pressure chamber 131 and provides negative pressure to the pressure chamber 131 at time t31. The second waveform element e32 generates a first standby time (t32-t31) that starts after the first waveform element e31. The third waveform element e33 returns the volume of the pressure chamber 131 to an original state and provides positive pressure to the pressure chamber at time t32 after the first standby time elapses. The fourth waveform element e34 generates a second standby time (t33-t32) that starts after the third waveform element e33. The fifth waveform element e35 contracts the volume of the pressure chamber 131 and provides positive pressure to the pressure chamber 131 at time t33 after the second standby time elapses. The sixth waveform element e36 generates a third standby time (t34-t33) that starts after the fifth waveform element e35. The seventh waveform element e37 returns the volume of the pressure chamber 131 slightly at time t34 after the third standby time elapses. In an example illustrated in FIG. 13, assuming that a contraction percentage by the waveform element e35 is 100%, the volume of the pressure chamber 131 returns such that a contraction percentage becomes 50%. The eighth waveform element e38 generates a fourth standby time (t35-t34) that starts after the seventh waveform element e37. The ninth waveform element e39 contracts the volume of the pressure chamber 131 again and provides positive pressure to the pressure chamber 131 at time t35 after the fourth standby time elapses. In the example illustrated in FIG. 13, assuming that a contraction percentage by the waveform element e35 is 100%, the volume of the pressure chamber 131 is contracted so as to have the equal contraction percentage. The tenth waveform element e40 generates a fifth standby time (t36-t35) that starts after the ninth waveform element e39. The eleventh waveform element e41 returns the volume of the pressure chamber 131 slightly at time t36 after the fifth standby time elapses. In the example illustrated in FIG. 13, assuming that a contraction percentage by the waveform element e39 is 100%, the volume of the pressure chamber 131 returns such that a contraction percentage becomes 50%. The twelfth waveform element e42 generates a sixth standby time (t37-t36) that starts after the eleventh waveform element e41. The thirteenth waveform element e43 returns the volume of the pressure chamber 131 to the original state at time t37 after the sixth standby time elapses.

Here, the first waveform element e31, the second waveform element e32, and the third waveform element e33 form an expansion pulse P31 that returns the volume of the pressure chamber 131 to the original state after expanding the volume of the pressure chamber 131. That is, the first waveform element e31 is a leading edge of the expansion pulse P31, the second waveform element e32 has a pulse width of the expansion pulse P31, and the third waveform element e33 is a trailing edge of the expansion pulse P31. A combination of the fifth waveform element e35, the sixth waveform element e36, and the seventh waveform element e37 forms a first contraction pulse P32 that slightly returns the volume of the pressure chamber 131 after contracting the volume of the pressure chamber 131 so as to bring the pressure chamber 131 into a contraction state (weak contraction state) weaker than the contraction state maintained by the sixth waveform element e36. That is, the fifth waveform element e35 is a leading edge of the first contraction pulse P32, the sixth waveform element e36 is a pulse width of the first contraction pulse P32, and the seventh waveform element e37 is a trailing edge of the first contraction pulse P32. The eighth waveform element e38 forms a first weak contraction pulse P33 for maintaining the weak contraction state of the pressure chamber 131 formed by the first contraction pulse P32 for a predetermined time. That is, the eighth waveform element e38 is a pulse width of the first weak contraction pulse P33. A combination of the ninth waveform element e39, the tenth waveform element e40, and the eleventh waveform element e41 forms a second contraction pulse P34 that slightly returns the volume of the pressure chamber 131 after contracting the volume of the pressure chamber 131 so as to bring the pressure chamber 131 into the weak contraction state. That is, the ninth waveform element e39 is a leading edge of the second contraction pulse P34, the tenth waveform element e40 is a pulse width of the second contraction pulse P34, and the eleventh waveform element e41 is a trailing edge of the second contraction pulse P34. A combination of the twelfth waveform element e42 and the thirteenth waveform element e43 forms a second weak contraction pulse P35 that returns the weak contraction state of the pressure chamber 131 to an original state after maintaining the weak contraction state of the pressure chamber 131 for a predetermined time. That is, the twelfth waveform element e42 is a pulse width of the second weak contraction pulse P35, and the thirteenth waveform element e43 is a trailing edge of the second weak contraction pulse P35.

At time t31 when the waveform element e31 is applied, that is at the leading edge of the expansion pulse P31, the partition walls 133 on the both sides are displaced to expand the volume of the pressure chamber 131. With this displacement, negative pressure is instantaneously applied to the ink in the pressure chamber 131, as illustrated in FIG. 13. As a result, a meniscus of the ink in the nozzle 301 is retracted.

Thereafter, the ink pressure is changed from negative pressure to positive pressure in accordance with a natural pressure vibration period of the ink in the pressure chamber. Further, when the first standby time, during which the waveform element e32 is applied, has elapsed at time t32, that is at the trailing edge of the first expansion pulse P31 when the waveform element e33 is applied, the volume of the pressure chamber 131 returns to the original state. As illustrated in FIG. 13, positive pressure is instantaneously applied to the ink. As described above, when positive pressure is instantaneously applied to the ink by a pulse change in a state in which the ink pressure is positive pressure equal to or higher than a threshold value, the meniscus begins to be advanced and a first ink droplet is discharged from the nozzle 301. That is, the first standby time is a time for waiting until the ink pressure increases from negative pressure at the leading edge of the expansion pulse P31 to the threshold value. The threshold value is a threshold pressure at which one ink droplet can be discharged by the instantaneous application of positive pressure to the ink at the trailing edge of the expansion pulse P31.

Thereafter, the ink pressure is changed from positive pressure to negative pressure in accordance with natural pressure vibration of the ink in the pressure chamber. Further, in the state in which the ink pressure is positive, when the second standby time, during which the waveform element e34 is applied, has elapsed at time t33, that is at the leading edge of the first contraction pulse P32 when the waveform element e35 is applied, the partition walls 133 on the both sides are displaced to contract the volume of the pressure chamber 131. With this displacement, positive pressure is instantaneously applied to the ink. Here, time t33 is a time at which the ink pressure becomes substantially the same value as that at time t32. Therefore, as positive pressure is instantaneously applied to the ink by a pulse change in the state in which the ink pressure is positive pressure equal to or higher than a threshold value, the meniscus begins to be advanced and a second ink droplet is discharged from the nozzle 301. That is, the second standby time is a time for waiting until the ink pressure increases to a pressure at which the second ink droplet can be discharged by the instantaneous application of positive pressure to the ink at the leading edge of the first contraction pulse P32.

The ink pressure is changed to negative pressure after the volume of the pressure chamber 131 is contracted. Further, when the third standby time, during which the waveform element e36 is applied, has elapsed at time t34, that is at the trailing edge of the contraction pulse P32 when the waveform element e37 is applied, the partition walls 133 on the both sides are displaced to return the volume of the pressure chamber 131 slightly. With this displacement, the pressure chamber 131 is brought into the weak contraction state weaker than the contraction state, so that the meniscus is retracted. Here, time t34 is included in a time period in which the ink pressure is being negative pressure and is a time at which negative ink pressure is maximized in the example illustrated in FIG. 13. At this time t34, the pressure chamber 131 is brought into the weak contraction state, and as a result, the amplitude of vibration of the ink pressure is increased.

The weak contraction state is maintained until the fourth standby time, during which the waveform element e38 is applied and the ink pressure is changed to the positive pressure, has elapsed. Further, at time t35, that is at the trailing edge of the weak contraction pulse P33 when the waveform element e39 is applied, the partition walls 133 on the both sides are displaced to contract the volume of the pressure chamber 131 again. With this displacement, positive pressure is instantaneously applied to the ink. Further, the meniscus is advanced again. Here, time t35 is set to be later than a time at which the ink pressure is substantially the same as that at the times t32 and t33. A magnitude of the waveform element e39, which provides positive pressure to discharge a third ink droplet, is only a half of a magnitude of the waveform element e33 for discharging a first ink droplet and a magnitude of the waveform element e35 for discharging a second ink droplet. Therefore, since it is necessary to wait until the ink pressure becomes higher than those in the case of discharging the first ink droplet and the second ink droplet, the timing of the waveform element 39 is delayed. Further, the ink pressure after performing the operation with the waveform element e39 at time t35 is substantially the same value as the ink pressure immediately after times t32 and t33. Therefore, since positive pressure is instantaneously applied to the ink by a pulse change in the state in which the ink pressure is positive pressure equal to or higher than a threshold value, a third ink droplet is discharged from the nozzle 301. That is, the fourth standby time is a time for waiting until the ink pressure increases to a pressure at which the third ink droplet can be discharged by the instantaneous application of positive pressure to the ink at the leading edge of the second contraction pulse P34.

In the state in which the volume of the pressure chamber 131 is contracted, when the fifth standby time, during which the waveform element e40 is applied, has elapsed at time t36, that is at the trailing edge of the second contraction pulse P34 when the waveform element e41 is applied, the partition walls 133 on the both sides are displaced such that the volume of the pressure chamber 131 returns slightly. With this displacement, the pressure chamber 131 is brought into a weak contraction state weaker than the contraction state. The weak contraction state is maintained until the sixth standby time, during which the waveform element e42 is applied, has elapsed. Further, at time t37, that is at the trailing edge of the second weak contraction pulse P35 when the waveform element e43 is applied, the volume of the pressure chamber 131 returns to the original state. At time t37, a magnitude of amplitude of vibration of the ink pressure is equal to negative pressure instantaneously applied to the ink by the trailing edge of the second weak contraction pulse P35, and the ink flow velocity is zero. Therefore, residual vibration in the pressure chamber 131 is cancelled thereafter. That is, the fifth standby time and the sixth standby time are timed such that the residual vibration in the pressure chamber 131 is cancelled by the trailing edge of the second weak contraction pulse P35.

As described above, when the drive voltage of the 3-drop waveform illustrated in FIG. 12 is applied to the actuator, the pressure chamber 131 is operated in the order of expansion, return, contraction, weak contraction, contraction, weak contraction, and return. Further, with the first operations of expansion and return, a first ink droplet is discharged from the nozzle 301 that communicates with the pressure chamber 131. In addition, with the subsequent operation of contraction, a second ink is discharged from the nozzle 301. Further, with the subsequent operations of weak contraction and contraction, a third ink droplet is discharged from the nozzle 301. Further, with the subsequent operations of weak contraction and return, residual vibration is cancelled after the third ink droplet is discharged.

By the way, in the aforementioned 2-drop waveform, the weak contraction pulse P23 is formed at the trailing edge of the contraction pulse P22, such that residual vibration is cancelled at the trailing edge of the weak contraction pulse P23. The same applies to the case of the 3-drop waveform. However, in a case in which damping of pressure vibration of the ink in the pressure chamber 131 is comparatively low, residual vibration may be cancelled at the trailing edge of the contraction pulse P22 in the 2-drop waveform or the 3-drop waveform, similar to the 1-drop waveform.

In the following, another 2-drop waveform, which cancels residual vibration at the trailing edge of the contraction pulse P22, will be described with reference to FIGS. 14 and 15.

Figure 14:
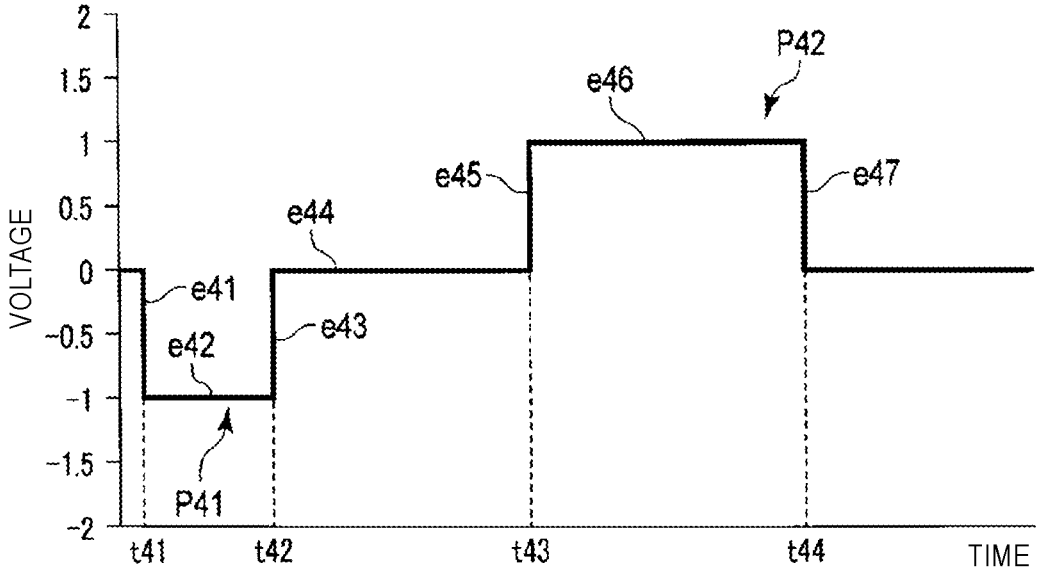
FIG. 14 depicts a drive voltage of modified 2-drop waveform applied to an actuator of an inkjet head.
Figure 15:
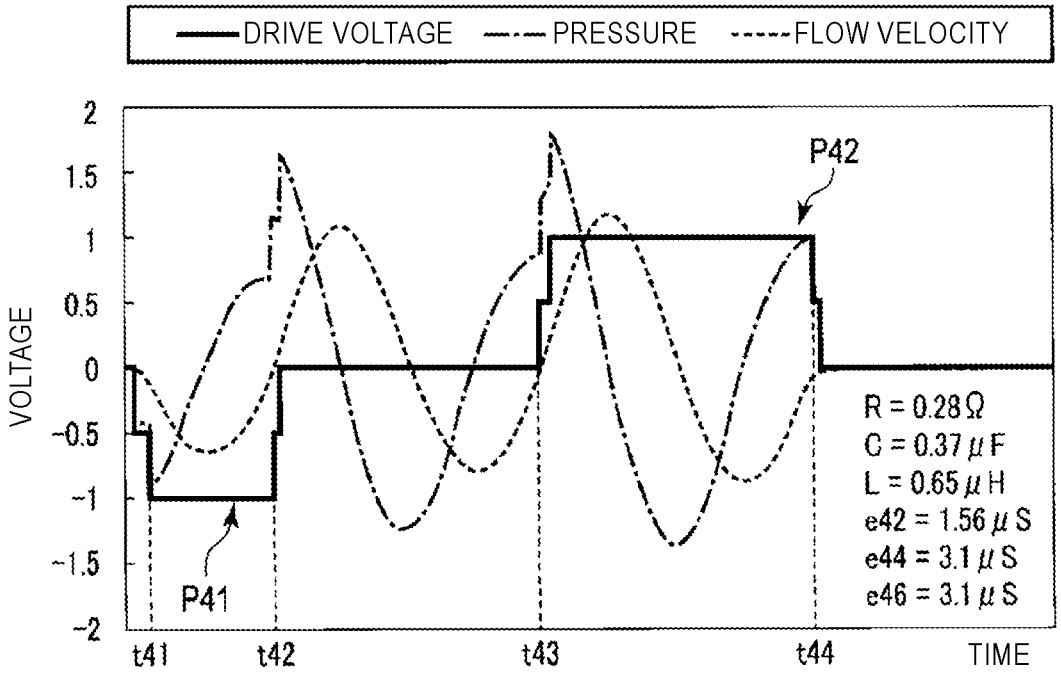
FIG. 15 depicts a drive voltage of a modified 2-drop waveform and simulated values of an ink pressure waveform and an ink flow velocity waveform under an application of the modified 2-drop waveform to an actuator of an inkjet head.

FIG. 14 depicts a drive voltage of a modified 2-drop waveform. FIG. 15 depicts the drive voltage of the modified 2-drop waveform and simulated values of an ink pressure and an ink flow velocity under the application of the modified 2-drop waveform to the actuator. In FIG. 15, the drive voltage waveform is indicated by the solid line, the ink pressure waveform is indicated by the dot dashed line, and the ink flow velocity waveform is indicated by the dashed line. In addition, values on a vertical axis are arbitrarily normalized.

As illustrated in FIG. 14, the modified 2-drop waveform includes first to seventh waveform elements e41 to e47. The first waveform element e41 expands the volume of the pressure chamber 131 and provides negative pressure to the pressure chamber 131 at time t41. The second waveform element e42 generates a first standby time (t42-t41) that starts after the first waveform element e41. The third waveform element e43 returns the volume of the pressure chamber 131 to an original state and provides positive pressure to the pressure chamber 131 at time t42 after the first standby time elapses. The fourth waveform element e44 generates a second standby time (t43-t42) that starts after the third waveform element e43. The fifth waveform element e45 contracts the volume of the pressure chamber 131 and provides positive pressure to the pressure chamber 131 at time t43 after the second standby time elapses. The sixth waveform element e46 generates a third standby time (t44-t43) that starts after the fifth waveform element e45. The seventh waveform element e47 returns the volume of the pressure chamber 131 to the original state at time t44 after the third standby time elapses.

A combination of the first waveform element e41, the second waveform element e42, and the third waveform element e43 forms an expansion pulse P41 that returns the volume of the pressure chamber 131 to the original state after expanding the volume of the pressure chamber 131. That is, the first waveform element e41 is a leading edge of the expansion pulse P41, the second waveform element e42 is a pulse width of the expansion pulse P41, and the third waveform element e43 is a trailing edge of the expansion pulse P41. A combination of the fifth waveform element e45, the sixth waveforms element e46, and the seventh waveform element e47 forms a contraction pulse P42 that returns the volume of the pressure chamber 131 to the original state after contracting the volume of the pressure chamber 131. That is, the fifth waveform element e45 is a leading edge of the contraction pulse P42, the sixth waveform element e46 is a pulse width of the contraction pulse P42, and the seventh waveform element e47 is a trailing edge of the contraction pulse P42.

At time t41, that is at the leading edge of the expansion pulse P41 when the waveform element e41 is applied, the partition walls 133 on the both sides are displaced to expand the volume of the pressure chamber 131. With this displacement, negative pressure is instantaneously applied to the ink in the pressure chamber 131, as illustrated in FIG. 15. As a result, a meniscus of the ink in the nozzle 301 is retracted.

Thereafter, the ink pressure is changed from negative pressure to positive pressure in accordance with a natural pressure vibration period of the ink in the pressure chamber. Further, when the first standby time, during which the waveform element e42 is applied, has elapsed at time t42, that is at the trailing edge of the expansion pulse P41 when the waveform element e43 is applied, the volume of the pressure chamber 131 returns to the original state. In this case, as illustrated in FIG. 15, positive pressure is instantaneously applied to the ink. As described above, when positive pressure is instantaneously applied to the ink by a pulse change in the state in which the ink pressure is positive pressure equal to or higher than a threshold value, the meniscus begins to be advanced. Further, a first ink droplet is discharged from the nozzle 301. That is, the first standby time is a time for waiting until the ink pressure increases from negative pressure at the leading edge of the expansion pulse P41 to a threshold value. The threshold value is a threshold pressure at which one ink droplet can be discharged by the instantaneous application of positive pressure to the ink at the trailing edge of the expansion pulse P41.

Thereafter, the ink pressure is changed from positive pressure to negative pressure in accordance with natural pressure vibration of the ink in the pressure chamber. When the ink pressure is changed to negative pressure, the meniscus is retracted late. Thereafter, the ink pressure is changed back to positive pressure. Further, when the second standby time, during which the waveform element e44 has elapsed at time t43, that is at the leading edge of the contraction pulse P42 when the waveform element e45 is applied, the partition walls 133 on the both sides are displaced to contract the volume of the pressure chamber 131. With this displacement, positive pressure is instantaneously applied to the ink. Here, time t43 is a time at which the ink pressure becomes substantially the same value as that at time t42. Therefore, as positive pressure is instantaneously applied to the ink by a pulse change in the state in which the ink pressure is positive pressure equal to or higher than a threshold value, the meniscus begins to be advanced and a second ink droplet is discharged from the nozzle 301. That is, the second standby time is a time for waiting until the ink pressure increases to a pressure at which the second ink droplet can be discharged by the instantaneous application of positive pressure to the ink at the leading edge of the contraction pulse P42.

In the state in which the volume of the pressure chamber 131 is contracted, when the third standby time, during which the waveform element e46 is applied, has elapsed at time t44, that is at the trailing edge of the contraction pulse P42 when the waveform element e47 is applied, the volume of the pressure chamber 131 returns to the original state. At time t44, a magnitude of amplitude of vibration of the ink pressure is equal to negative pressure instantaneously applied to the ink by the trailing edge of the contraction pulse P42, and the ink flow velocity is zero. Therefore, residual vibration in the pressure chamber 131 is cancelled thereafter. That is, the third standby time is timed such that the residual vibration in the pressure chamber 131 is cancelled by the trailing edge of the contraction pulse P42.

As described above, as the drive voltage of the modified 2-drop waveform illustrated in FIG. 14 is applied to the actuator, the pressure chamber 131 is operated in the order of expansion, return, contraction, and return. Further, with the first operations of expansion and return, a first ink droplet is discharged from the nozzle 301 that communicates with the pressure chamber 131. In addition, with the subsequent operation of contraction, a second ink droplet is discharged from the nozzle 301. Further, with the subsequent operation of return, residual vibration is cancelled after the ink droplet is discharged.

In the modified 2-drop waveform illustrated in FIG. 14, the waveform element, which may be used to cancel residual vibration, is limited to the waveform element e47 that is the trailing edge of the contraction pulse P42. Further, since the output timing of the waveform element e47 is limited to the aforementioned timing, a degree of freedom is small at the time of cancellation. Whether the modified 2-drop waveform illustrated in FIG. 14 is available depends on a magnitude of damping of residual vibration of the ink. That is, in a case in which the damping of residual vibration of the ink is comparatively high, a pressure change in the waveform element e47 is too large, and as a result, residual vibration may not be cancelled well in some instances.

During an application of the 2-drop waveform or the 3-drop waveform illustrated in FIG. 10 or 12, the pressure chamber 131 is in the weak contraction state after the trailing edge of the contraction pulse P22 or the second contraction pulse P34. While the pressure chamber 131 is in the weak contraction state after the trailing edge of the contraction pulse, it is possible to adjust the time t25 for the waveform element e29 or the time t27 for the waveform element e43 for cancellation. For this reason, the timing for cancellation of the residual vibration may not be uniquely determined. In the following, a method of determining timings of waveform elements for cancellation of the residual vibration will be described using a 2-drop waveform as an example with reference to FIGS. 16 to 19.

FIG. 16 is a waveform chart for explaining residual vibration after stopping the contraction pulse P22 at time t24 and a simulation result of an ink pressure and an ink flow velocity under a hypothetical condition that the weak contraction state of the pressure chamber 131 is continuously maintained without stopping the weak contraction pulse P23 of the 2-drop waveform at time point t25, for the purpose of explaining a method of determining an appropriate time t25 at which the weak contraction pulse P23 should be stopped. In FIG. 16, the drive voltage waveform is indicated by the solid line, the ink pressure waveform is indicated by the dot dashed line, and the ink flow velocity waveform is indicated by the dashed line. In addition, values on a vertical axis are arbitrarily normalized.

As illustrated in FIG. 16, residual vibration would not be cancelled if the weak contraction state of the pressure chamber 131 is maintained even after time t25. The magnitude of the residual vibration depends on a timing of the time t24 at which the contraction state transitions to the weak contraction state. If the time t24 at which the contraction state transitions to the weak contraction state is shifted to before or after time t24, the ink pressure and the ink flow velocity change at the time t24, and thereafter, a magnitude of the residual vibration changes. In an example illustrated in FIG. 16, the residual vibration increases if the time t24 is shifted earlier, and the residual vibration decreases if the time t24 is shifted later. That is, a value of the ink pressure at the time when the ink velocity is zero can be adjusted by adjusting a timing of the time t24 earlier or later. Therefore, a condition that an ink pressure amplitude at a time when the ink flow velocity is zero coincides with an ink pressure amplitude after the weak contraction state of the pressure chamber 131 returns to an initial state can be found by a simulation varying timings of the time t24. The timing of the time t24 that satisfies this condition is set as the time t24. Further, the time at which the ink flow velocity is zero is set as timing at the trailing edge of the weak contraction pulse P23, that is, time t25. As such, it is possible to cancel residual vibration, as illustrated in FIG. 10.

The simulation may be performed using an equivalent circuit illustrated in FIG. 17. The equivalent circuit is a circuit in which a series circuit including a resistor R, a capacitor C, and an inductor L is connected to a voltage source V. In the case of the 2-drop waveform illustrated in FIG. 11, the resistor R is 0.33Ω, the capacitor C is 0.37 μF, and the inductor L is 0.65 pH. Further, in this case, the first standby time (t22-t21) is 1.56 μs, the second standby time (t23-t22) is 2.80 μs, the third standby time (t24-t23) is 2.94 μs, and the fourth standby time (t25-t24) is 0.66 μs. This equivalent circuit is extracted from residual vibration characteristics of the inkjet head 1, and the values of the resistor R, the capacitor C, and the inductor L are determined based on the residual vibration characteristics.

A loss of the pressure chamber 131 is represented by the value of the resistor R of the equivalent circuit. If a loss of the pressure chamber 131 is higher, that is, the value of the resistor R is larger, pressure amplitude of the residual vibration is smaller. In this case, time t24 at which the contraction state transitions to the weak contraction state should be shifted earlier. In this way, it is possible adjust the pressure amplitude of the residual vibration at when the ink flow velocity is zero, up to the pressure amplitude generated by the change of the state of the pressure chamber 131 from the weak contraction state to the initial state. Then, the time ink flow velocity is zero is set as time t25 at which the weak contraction state is ended.

Figure 18:
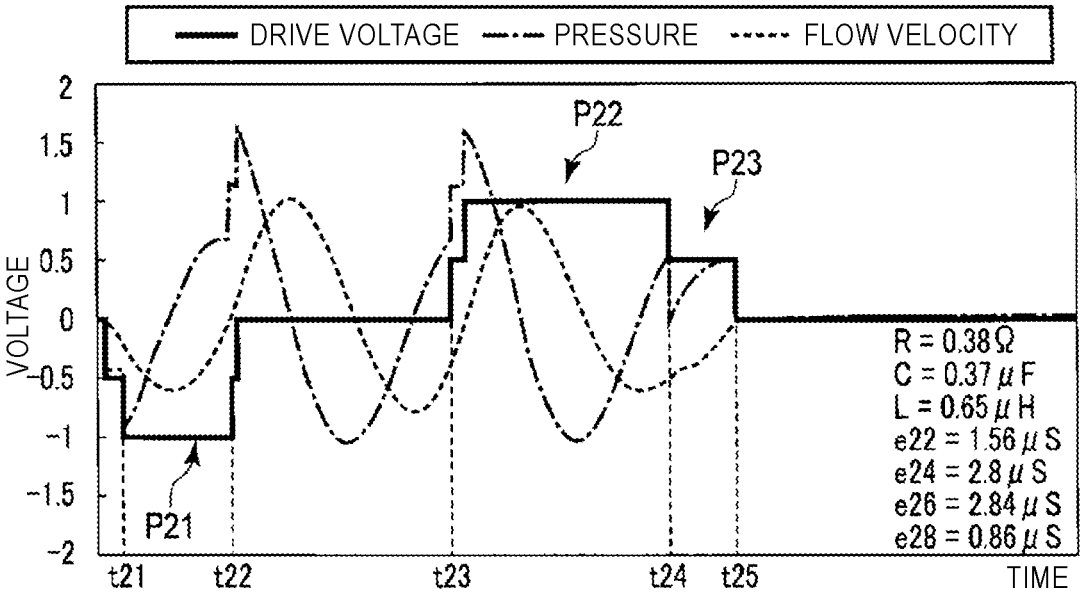
FIG. 18 is a second waveform chart for explaining the method of determining the trailing edge of the contraction pulse and the trailing edge of the weak contraction pulse of the 2-drop waveform.

For example, when the appropriate times t24 and t25 are selected by increasing the resistor R to 0.38Ω and performing the simulation, the drive voltage waveform, the ink pressure waveform, and the ink flow velocity waveform are made as illustrated in FIG. 18. In FIG. 18, the first standby time (t22-t21) is 1.56 μs, the second standby time (t23-t22) is 2.80 μs, the third standby time (t24-t23) is 2.84 μs, and the fourth standby time (t25-t24) is 0.86 μs.

On the contrary, when a loss of the pressure chamber 131 is lower, that is, the value of the resistor R is smaller, residual vibration is larger. In this case, time t24 at which the contraction state transitions to the weak contraction state should be shifted later. In this way, it is possible adjust the pressure amplitude of the residual vibration at when the ink flow velocity is zero, down to the pressure amplitude generated by the change of the state of the pressure chamber 131 from the weak contraction state to the initial state. Then, the time ink flow velocity is zero is set as time t25 at which the weak contraction state is ended.

Figure 19:
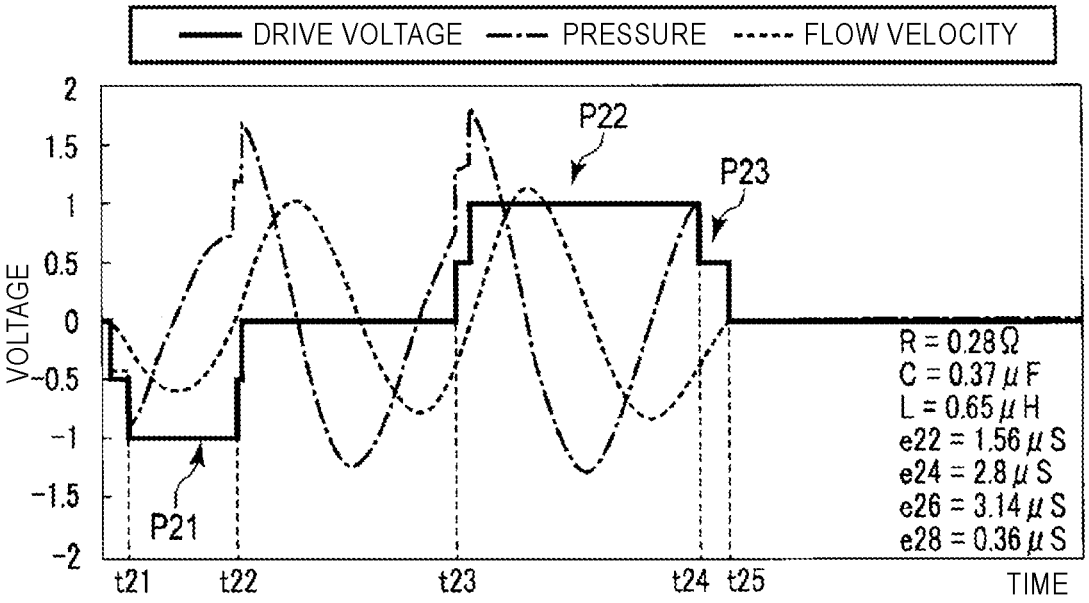
FIG. 19 is a third waveform chart for explaining the method of determining the trailing edge of the contraction pulse and the trailing edge of the weak contraction pulse of the 2-drop waveform.

For example, when appropriate times t24 and t25 are selected by decreasing the resistor R to 0.28Ω and performing the simulation, the drive voltage waveform, the ink pressure waveform, and the ink flow velocity waveform are made as illustrated in FIG. 19. In FIG. 19, the first standby time (t22-t21) is 1.56 μs, the second standby time (t23-t22) is 2.80 μs, the third standby time (t24-t23) is 3.14 μs, and the fourth standby time (t25-t24) is 0.36 μs.

Since the step of bringing the pressure chamber into the weak contraction state is provided at the trailing edge of the contraction pulse as described above, it is possible to adjust the waveform element e29 or the waveform element e43 for cancellation in accordance with a magnitude of damping of residual vibration of the ink, and as a result, the degree of freedom is widened at the time of cancellation.

Next, an operation of the drive circuit 40 will be described with reference to FIG. 20 to FIGS. 23A to 23C.

Figure 20:
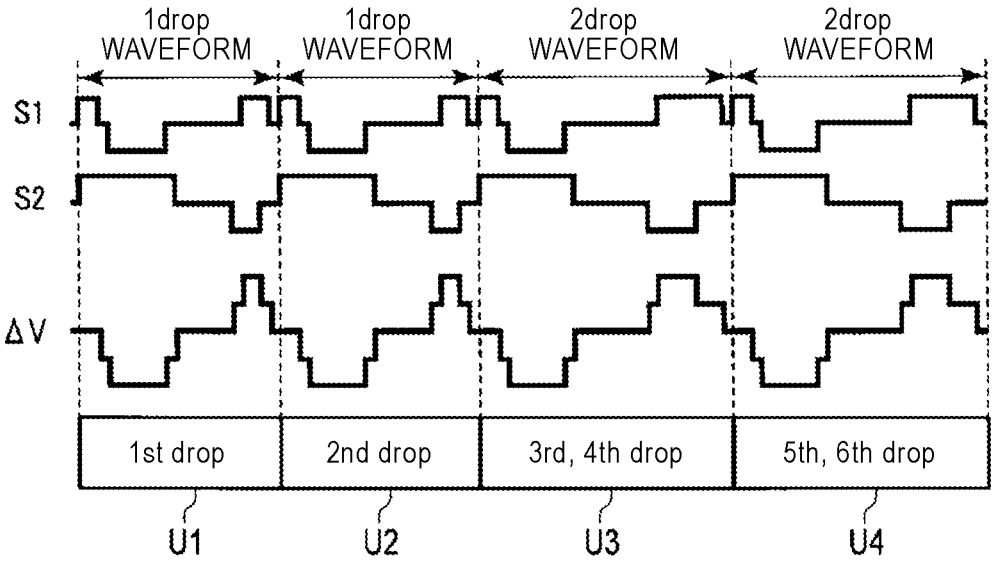
FIG. 20 depicts a first example of a combination of drive waveform units.

FIG. 20 depicts a first example of a combination of drive waveform units. In FIG. 20, the drive waveform generating units 414 and 424 select the 1-drop waveform setting units 411 and 421 twice, subsequently select the 2-drop waveform setting units 412 and 422 twice, and then generate a drive waveform signal by connecting the drive waveform units. In FIG. 20, the waveform signal S1 is a drive waveform signal S1 which is generated by the drive waveform generating unit 414 and applied to the first electrode 134 of the pressure chamber 131 via the first driver 451. The waveform signal S2 is a drive waveform signal S2 which is generated by the drive waveform generating unit 424 and applied to the second electrodes 135 of the two adjacent dummy chambers 132 via the second drivers 452. A waveform signal ΔV indicates differential voltage between the drive waveform signal S1 and the drive waveform signal S2. In addition, a first unit U1 indicates waveforms of the drive waveform units selected for the first time by the drive waveform generating units 414 and 424, and differential voltage thereof. A second unit U2 indicates waveforms of the drive waveform units selected for the second time by the drive waveform generating units 414 and 424, and differential voltage thereof. Likewise, third and fourth units U3 and U4 indicate waveforms of the drive waveform units selected for the third or fourth time, and differential voltage thereof.

In the first example illustrated in FIG. 20, when the waveform of the first unit U1 or the second unit U2 is applied to the actuator of the pressure chamber 131, one ink droplet is discharged from the nozzle 301. When the waveform of the third unit U3 or the fourth unit U4 is applied to the actuator of the pressure chamber 131, two ink droplets are consecutively discharged from the nozzle 301.

The waveform selecting unit 44 outputs a selecting signal that validates a period of the first unit U1 when a gradation value of printing data is 1. When the gradation value is 2, the waveform selecting unit 44 outputs a selecting signal that validates a period of the first unit U1 and a period of the second unit U2. When the gradation value is 3, the waveform selecting unit 44 outputs a selecting signal that validates periods of the 2nd and 3rd units U2, U3. When the gradation value is 4, the waveform selecting unit 44 outputs a selecting signal that validates periods of the first to third units U1 to U3. When the gradation value is 5, the waveform selecting unit 44 outputs a selecting signal that validates periods of the 2nd to 4th units U2, U3, U4. When the gradation value is 6, the waveform selecting unit 44 outputs a selecting signal that validates periods of the first to fourth units U1 to U4.

Figure 22A:
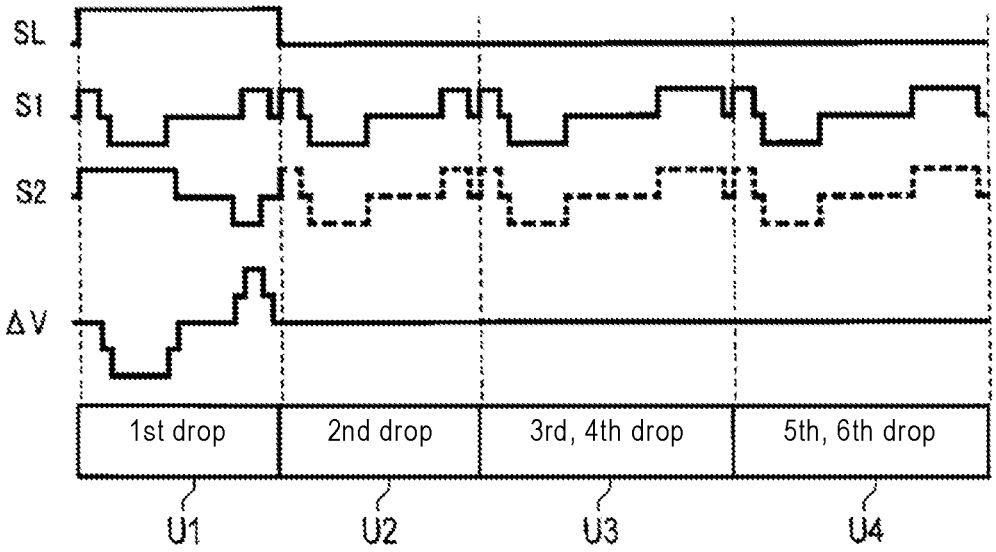
FIGS. 22A, 22B, and 22C depict waveform examples according to the first example illustrated in FIG. 20.

FIG. 22A illustrates a waveform example in which the waveform selecting unit 44 outputs the selecting signal SL that validates the period of the first unit U1. For the period of the first unit U1 in which the selecting signal SL is ON, the drive waveform signal S1 is applied to the first electrode 134, and the drive waveform signal S2 is applied to the second electrode 135. As a result, differential voltage ΔV between the drive waveform signal S1 and the drive waveform signal S2 is applied to the actuator of the pressure chamber 131, and as a result, one ink droplet is discharged from the nozzle 301 that communicates with the pressure chamber 131. For the periods of the second to fourth units U2, U3, and U4 in which the selecting signal SL is OFF, the drive waveform signal S1 is applied to the first electrode 134, but the drive waveform signal S2 is not applied to the second electrode 135, and the second electrode 135 comes into a floating state. For this reason, electric potential of the second electrode 135 depends on electric potential of the first electrode 134. As a result, the differential voltage ΔV becomes zero, and as a result, no ink droplet is discharged. As such, one ink droplet is discharged during one printing cycle.

Figure 22B:
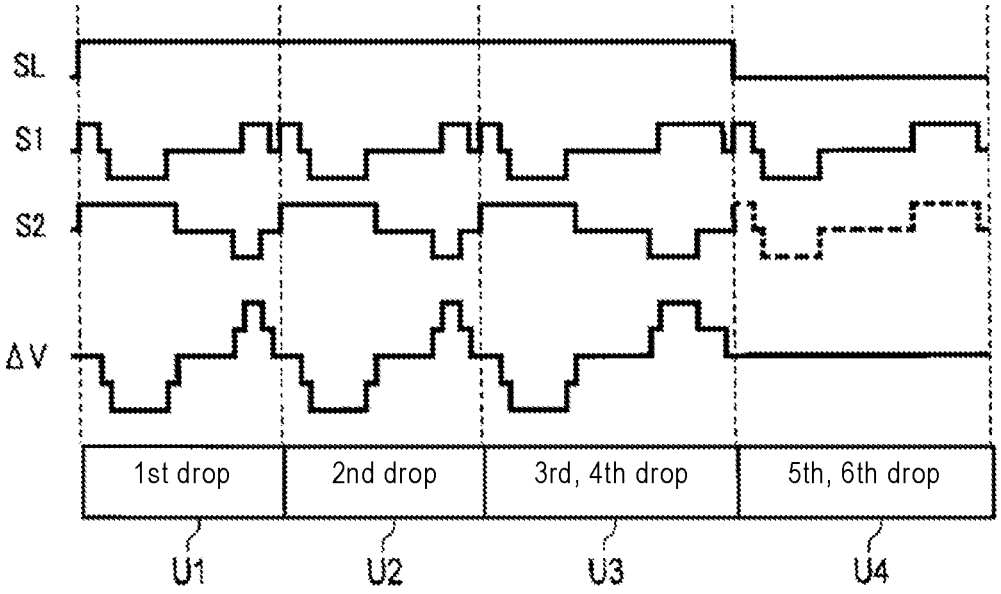

FIG. 22B illustrates a waveform example in which the waveform selecting unit 44 outputs the selecting signal SL that validates the periods of the first to third units U1, U2, and U3. For the periods of the first to third units U1, U2, and U3 in which the selecting signal SL is ON, the drive waveform signal S1 is applied to the first electrode 134, and the drive waveform signal S2 is applied to the second electrode 135. As a result, the differential voltage ΔV between the drive waveform signal S1 and the drive waveform signal S2 is applied to the actuator of the pressure chamber 131, and as a result, four ink droplets are consecutively discharged from the nozzle 301 that communicates with the pressure chamber 131. That is, one ink droplet is discharged for the period of the first unit U1, and one ink droplet is also discharged for the period of the second unit U2. In addition, two ink droplets are sequentially discharged for the period of the third unit U3. For the period of the fourth unit U4 in which the selecting signal SL is OFF, the drive waveform signal S1 is applied to the first electrode 134, but the drive waveform signal S2 is not applied to the second electrode 135, and the second electrode 135 comes into a floating state. For this reason, electric potential of the second electrode 135 depends on electric potential of the first electrode 134. As a result, the differential voltage ΔV becomes zero, and as a result, no ink droplet is discharged. As such, four ink droplets are discharged in one printing cycle.

Figure 22C:
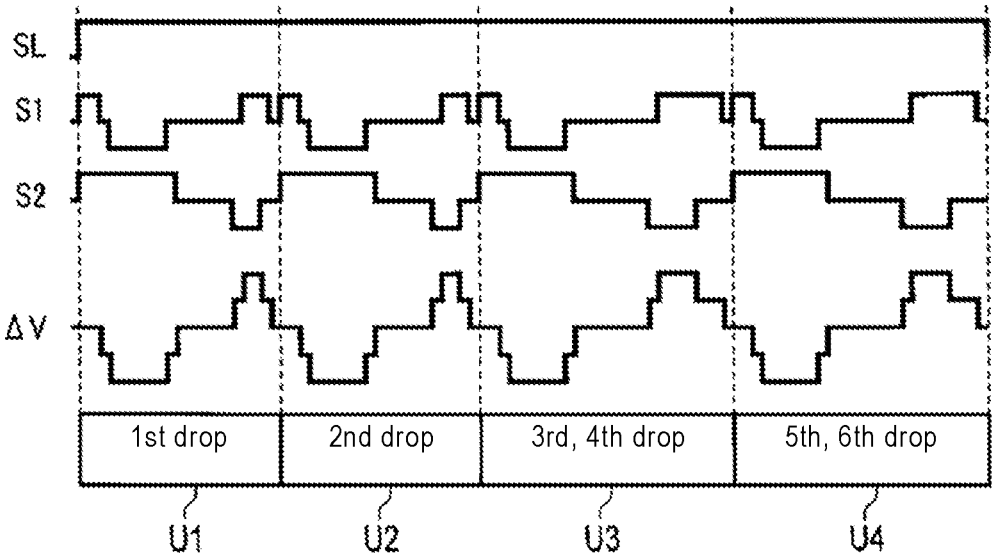

FIG. 22C illustrates a waveform example in which the waveform selecting unit 44 outputs the selecting signal SL that validates the periods of the first to fourth units U1, U2, U3, and U4. For the periods of the first to fourth units U1, U2, U3, and U4 in which the selecting signal SL is ON, the drive waveform signal S1 is applied to the first electrode 134, and the drive waveform signal S2 is applied to the second electrode 135. As a result, the differential voltage ΔV between the drive waveform signal S1 and the drive waveform signal S2 is applied to the actuator of the pressure chamber 131, and as a result, six ink droplets are consecutively discharged from the nozzle 301 that communicates with the pressure chamber 131. That is, one ink droplet is discharged for the period of the first unit U1, and one ink droplet is also discharged for the period of the second unit U2. In addition, two ink droplets are sequentially discharged for the period of the third unit U3, and two ink droplets are also continuously discharged for the period of the fourth unit U4. As such, six ink droplets are discharged in one printing cycle.

Although not illustrated, when the waveform selecting unit 44 outputs the selecting signal SL that validates the period of the first unit U1 and the period of the second unit U2, two ink droplets are continuously discharged in one printing cycle.

Therefore, the ink droplets are selectively discharged by one ink droplet, two ink droplets, four ink droplets, or six ink droplets in accordance with printing data, thereby realizing a multi-drop method of performing gradation printing.

Although not illustrated, when the waveform selecting unit 44 outputs the selecting signal SL that validates the period of the second unit U2 and the period of the third unit U3, three ink droplets are continuously discharged in one printing cycle.

Although not illustrated, when the waveform selecting unit 44 outputs the selecting signal SL that validates the period of the second unit U2 and the periods of the third and fourth units U3 and U4, five ink droplets are continuously discharged in one printing cycle.

When it is programmable which period the waveform selecting unit 44 validates in relation to a predetermined gradation value, zero to six ink droplets may be discharged with any combination of the units U1 to U4 in relation to the gradation value.

Figure 21:
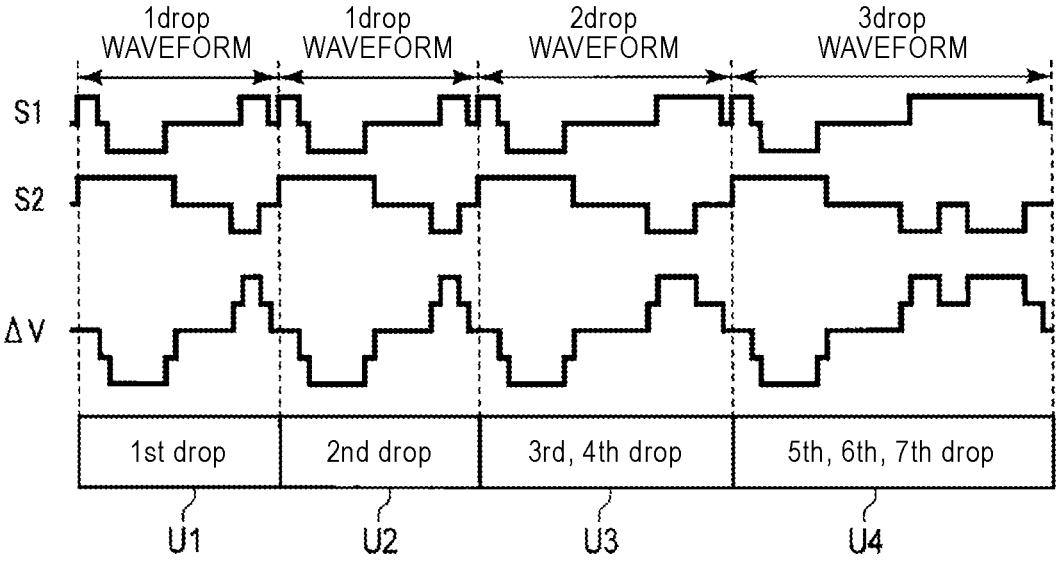
FIG. 21 depicts a second example of a combination of drive waveform units.

FIG. 21 depicts a second example of a combination of drive waveform units. In FIG. 21, the drive waveform generating units 414 and 424 the 1-drop waveform setting units 411 and 421 twice, subsequently select the 2-drop waveform setting units 412 and 422 once, further select the 3-drop waveform setting units 413 and 423 once, and then generate a drive waveform signal. In FIG. 21, the symbols S1, S2, ΔV, U1, U2, U3, and U4 are the same as those illustrated in FIG. 20.

In an example illustrated in FIG. 21, when the waveform of the first unit U1 or the second unit U2 is applied to the actuator of the pressure chamber 131, one ink droplet is discharged from the nozzle 301. When the waveform of the third unit U3 is applied to the actuator of the pressure chamber 131, two ink droplets are consecutively discharged from the nozzle 301. When the waveform of the fourth unit U4 is applied to the actuator of the pressure chamber 131, three ink droplets are consecutively discharged from the nozzle 301.

The waveform selecting unit 44 outputs a selecting signal that validates a period of the first unit U1 when a gradation value of printing data is 1. When the gradation value is 2, the waveform selecting unit 44 outputs a selecting signal that validates a period of the first unit U1 and a period of the second unit U2. When the gradation value is 3, the waveform selecting unit 44 outputs a selecting signal that validates periods of the 2nd and 3rd units U2, U3. When the gradation value is 4, the waveform selecting unit 44 outputs a selecting signal that validates periods of the first to third units U1 to U3. When the gradation value is 5, the waveform selecting unit 44 outputs a selecting signal that validates periods of the 3rd and 4th units U3, U4. When the gradation value is 6, the waveform selecting unit 44 outputs a selecting signal that validates periods of the 2nd to 4th units U2, U3, U4. When the gradation value is 7, the waveform selecting unit 44 outputs a selecting signal that validates periods of the first to fourth units U1 to U4.

Figure 23A:
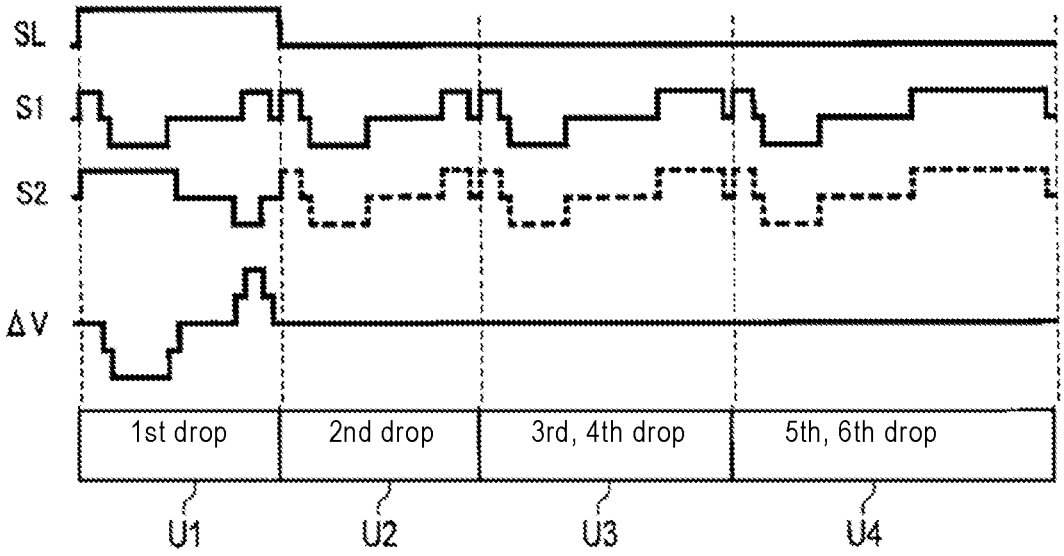
FIGS. 23A, 23B, and 23C depict waveform examples according to the second example illustrated in FIG. 21.
Figure 23B:
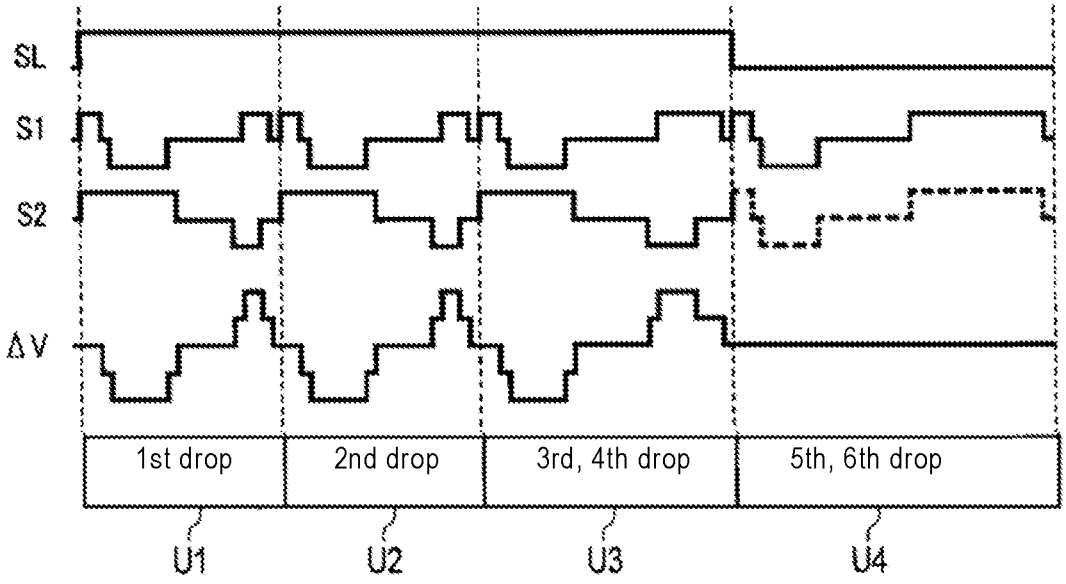

FIG. 23A illustrates a waveform example in which the waveform selecting unit 44 outputs the selecting signal SL that validates the period of the first unit U1. In addition, FIG. 23B illustrates a waveform example in which the waveform selecting unit 44 outputs the selecting signal SL that validates the periods of the first to third units U1, U2, and U3. Because these examples are identical to the examples described with reference to FIGS. 22A and 22B, a description thereof will be omitted.

Figure 23C:
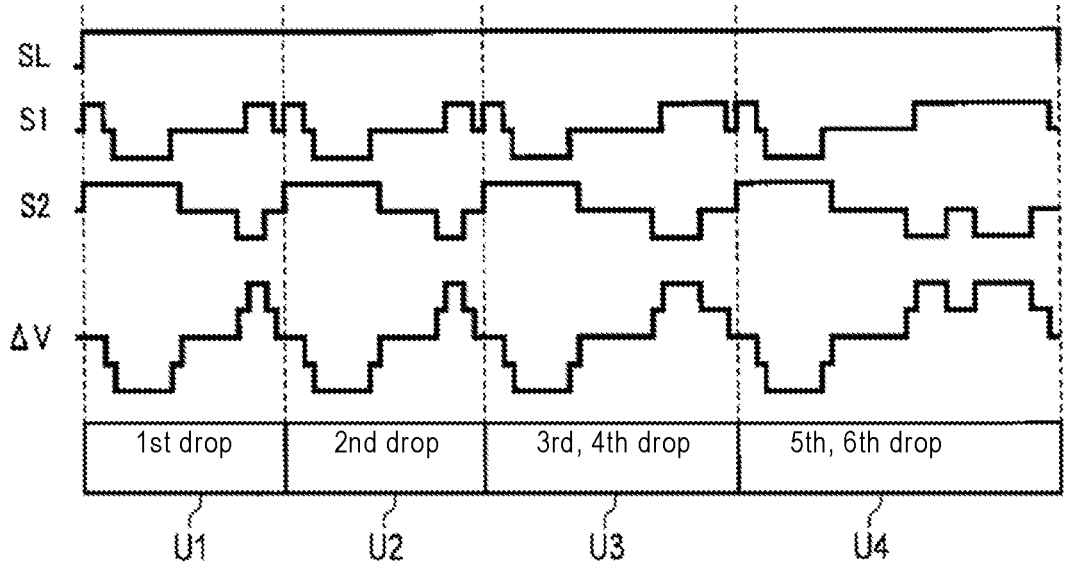

FIG. 23C illustrates a waveform example in which the waveform selecting unit 44 outputs the selecting signal SL that validates the periods of the first to fourth units U1, U2, U3, and U4. For the periods of the first to fourth units U1, U2, U3, and U4 in which the selecting signal SL is ON, the drive waveform signal S1 is applied to the first electrode 134, and the drive waveform signal S2 is applied to the second electrode 135. As a result, the differential voltage ΔV between the drive waveform signal S1 and the drive waveform signal S2 is applied to the actuator of the pressure chamber 131, and as a result, seven ink droplets are consecutively discharged from the nozzle 301 that communicates with the pressure chamber 131. That is, one ink droplet is discharged for the period of the first unit U1, and one ink droplet is also discharged for the period of the second unit U2. In addition, two ink droplets are sequentially discharged for the period of the third unit U3, and three ink droplets are continuously discharged for the period of the fourth unit U4. As such, seven ink droplets are discharged in one printing cycle.

Although not illustrated, when the waveform selecting unit 44 outputs the selecting signal SL that validates the period of the first unit U1 and the period of the second unit U2, two ink droplets are consecutively discharged in one printing cycle.

Therefore, the ink droplets are selectively discharged as one ink droplet, two ink droplets, four ink droplets, or seven ink droplets in accordance with printing data, thereby realizing a multi-drop method of performing gradation printing.

Although not illustrated, when the waveform selecting unit 44 outputs the selecting signal SL that validates the period of the second unit U2 and the period of the third unit U3, three ink droplets are consecutively discharged in one printing cycle.

Although not illustrated, when the waveform selecting unit 44 outputs the selecting signal SL that validates the periods of the third and fourth units U3 and U4, five ink droplets are consecutively discharged in one printing cycle.

Although not illustrated, when the waveform selecting unit 44 outputs the selecting signal SL that validates the periods of the 2nd to 4th units U2, U3, and U4, six ink droplets are consecutively discharged in one printing cycle.

When it is programmable which period the waveform selecting unit 44 validates in relation to a predetermined gradation value, zero to seven droplets may be effectively discharged by validating any combination of the periods of the units U1 to U4 in relation to the gradation value.

There are multiple combinations of the periods of the units U1 to U4 for discharging a predetermined number of ink droplets in one printing cycle. For example, to discharge two ink droplets in one printing cycle, the period of the unit U3 may be used, or the periods of the units U1 and U2 may be used. To discharge three ink droplets in one printing cycle, the periods of the units U1 and U3 may be combined, the period of the unit U4 may be used, or the periods of the units U2 and U3 may be used. To discharge five ink droplets in one printing cycle, the periods of the units U1, U2, and U4 may be combined, or the periods of the units U3 and U4 may be combined. Because timing for discharging ink droplets varies depending on such combinations even for discharging a same number of ink droplets, there may be a difference in printing characteristics. A combination for discharging a predetermined number of ink droplets in one printing cycle may be selected in accordance with desired printing characteristics.

The inkjet head 1 according to the example embodiments described above can discharge two ink droplets from the nozzle 301 by using the 2-drop waveform illustrated in FIG. 10 or 14. The 2-drop waveform discharges two ink droplets with a sequence of operations of single expansion, return, and contraction. This sequence is identical to those of the 1-drop waveform illustrated in FIG. 8. Therefore, it is possible to discharge two ink droplets as the same number of times the charging and discharging as in the 1-drop waveform, and as a result, it is possible to reduce power consumption and heat generation for discharging ink droplets. In addition, no waveform element for cancelling residual vibration is inserted between the first ink droplet and the second ink droplet, and the residual vibration is cancelled by the returning operation after the consecutive discharge of two ink droplets ends, and as a result, time required to discharge two ink droplets is reduced. As a result, a high-speed operation is enabled.

The degree of freedom when cancelling residual vibration is higher in the case in which the 2-drop waveform illustrated in FIG. 10 is used than in the case in which the 2-drop waveform illustrated in FIG. 14 is used, and as a result, it is possible to appropriately cancel residual vibration. As a result, discharge stability is improved, printing quality is improved, and a higher-speed operation is enabled.

The inkjet head 1 according to the example embodiments described above can discharge three ink droplets from the nozzle 301 by using the 3-drop waveform illustrated in FIG. 12. The 3-drop waveform discharges three ink droplets with a series of operations of single expansion, return, contraction, weak contraction, and contraction. This series of operations reduces the number of times the charging and discharging must be performed in comparison with the case in which three ink droplets are discharged by using the 1-drop waveform and the 2-drop waveform in combination, and as a result, it is possible to reduce power consumption and heat generation for discharging ink droplets. In addition, time required to discharge all of three ink droplets is shorter, and, as a result, a high-speed operation is enable. Furthermore, in the case in which the 3-drop waveform illustrated in FIG. 12 is used, it is possible to cancel residual vibration after three ink droplets are consecutively discharged from the nozzle 301.

Hereinafter, modified examples of the present example embodiments described above will be described.

In the example embodiments described above, as illustrated in FIGS. 11, 13, and 15, the ink pressure at times t23, t33, and t43 when the second ink droplet is discharged is set to be substantially the same as the ink pressure at the times t22, t32, and t42 at which the first ink droplet is discharged. However, the two ink pressures do not have to be equal to each other. In summary, it is sufficient for the ink pressure to have reached positive pressure such that the ink may be discharged by a pulse change of the waveform elements e25, e35, and e45 for discharging the second ink droplet.

Figure 24:
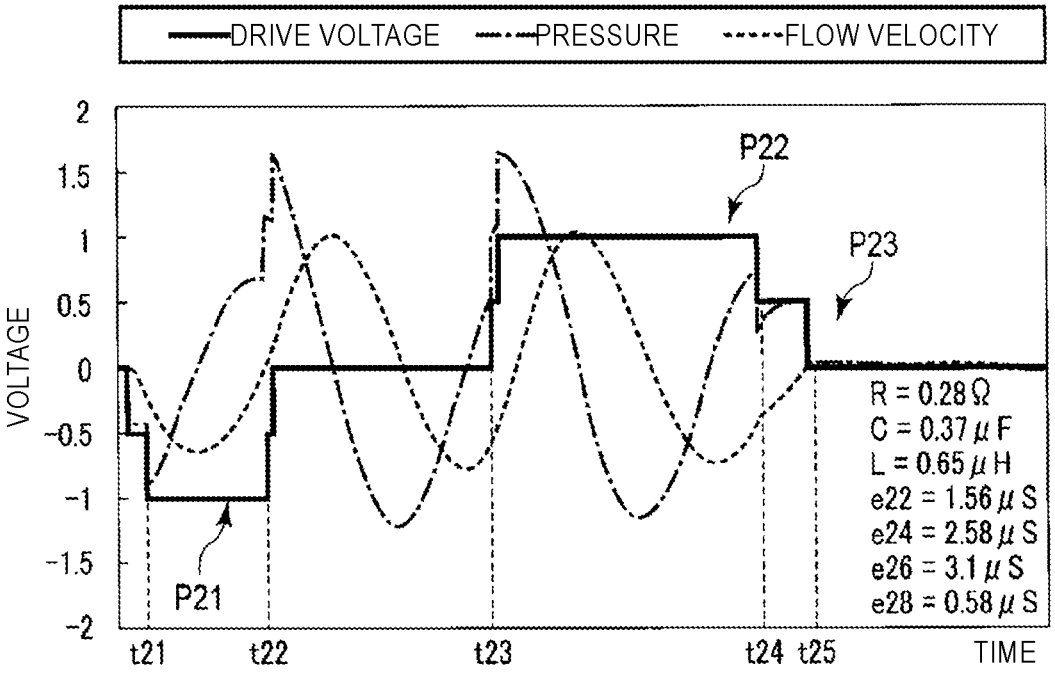
FIG. 24 depicts a drive voltage of a 2-drop waveform and simulated results of an ink pressure and an ink flow velocity when the time point of the leading edge of the contraction pulse of the 2-drop waveform illustrated in FIG. 10 is advanced.

FIG. 24 depicts a drive voltage of a 2-drop waveform and simulated results of an ink pressure and an ink flow velocity. In FIG. 24, time t23 of the leading edge of the contraction pulse P22 is advanced from the 2-drop waveform illustrated in FIG. 10. In FIG. 24, the drive voltage waveform is indicated by the solid line, the ink pressure waveform is indicated by the dot dashed line, and the ink flow velocity waveform is indicated by the dashed line. In addition, values on a vertical axis are arbitrarily normalized.

In this example, while a time at which the normalized ink pressure is 0.75 is set as time t22 of the trailing edge of the expansion pulse P21, a time at which the normalized ink pressure is 0.5 is set as time t23 of the leading edge of the contraction pulse P22. In this waveform, the discharge velocity of the second ink droplet is lower than that of the first ink droplet, but even with this 2-drop waveform, it is possible to discharge two ink droplets from the nozzle 301.

Figure 25:
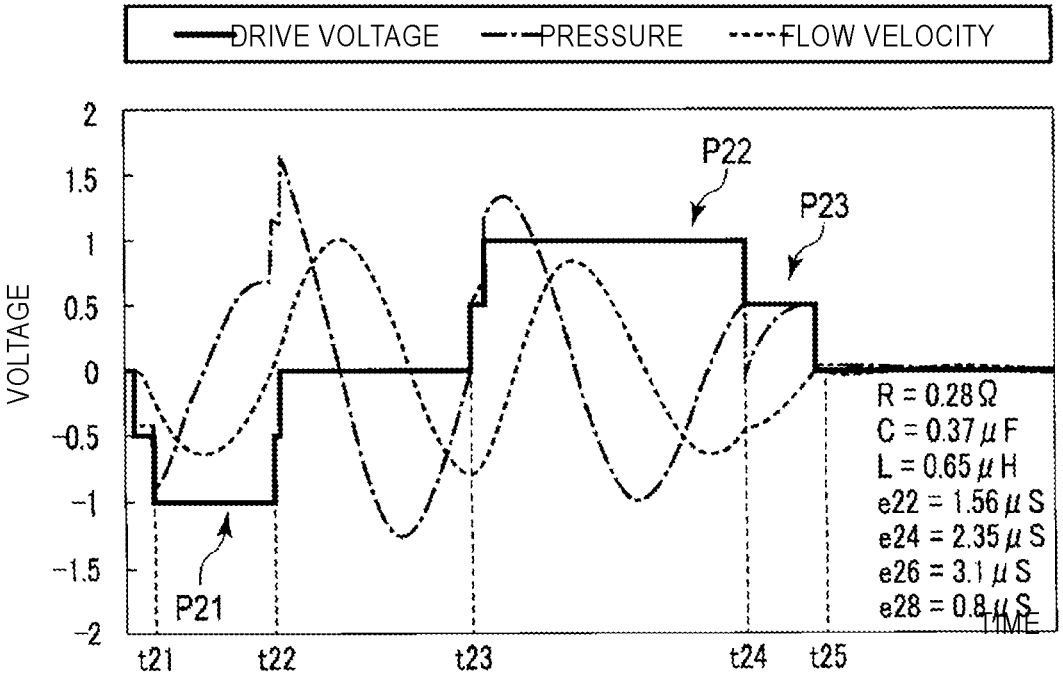
FIG. 25 depicts a drive voltage of a 2-drop waveform and simulated results of an ink pressure and an ink flow velocity when a contraction pulse of the 2-drop waveform is applied at an earlier timing than in FIG. 10.

FIG. 25 depicts a drive voltage of a 2-drop waveform and simulated values of an ink pressure and an ink flow velocity. In FIG. 25, time t23 of the leading edge of the contraction pulse P22 is further advanced from the 2-drop waveform illustrated in FIG. 24. In FIG. 25, the drive voltage waveform is indicated by the solid line, the ink pressure waveform is indicated by the dot dashed line, and the ink flow velocity waveform is indicated by the dashed line. In addition, values on a vertical axis are arbitrarily normalized.

In this example, while a time at which the normalized ink pressure is 0.75 is set as time t22 of the trailing edge of the expansion pulse P21, a time at which the normalized ink pressure is changed to positive pressure is set as time t23 of the leading edge of the contraction pulse P22. In this waveform, the discharge velocity of the second ink droplet becomes further lower than that of the first ink droplet, but even with this 2-drop waveform, it is possible to continuously discharge two ink droplets from the nozzle 301.

Figure 26:
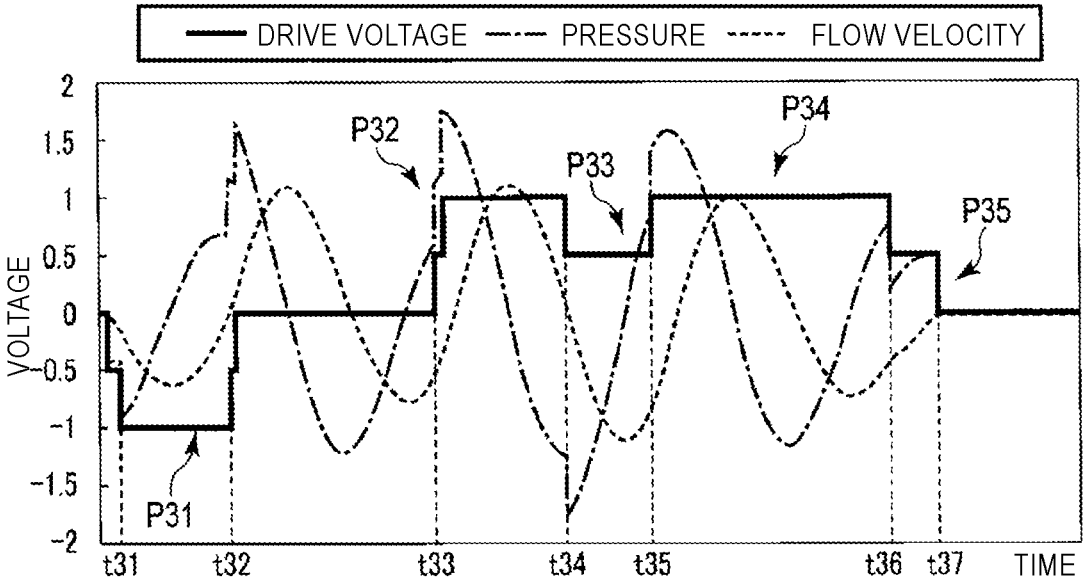
FIG. 26 depicts a drive voltage of a 3-drop waveform and simulated values of an ink pressure and an ink flow velocity when a second contraction pulse of the 3-drop waveform is applied at an earlier timing than in FIG. 12.

FIG. 26 depicts a drive voltage of a 3-drop waveform and simulated values of an ink pressure and an ink flow velocity. In FIG. 26, time t35 of the leading edge of the second contraction pulse P34 is advanced from the 3-drop waveform illustrated in FIG. 12. In FIG. 26, the drive voltage waveform is indicated by the solid line, the ink pressure waveform is indicated by the dot dashed line, and the ink flow velocity waveform is indicated by the dashed line. In addition, values on a vertical axis are arbitrarily normalized.

FIG. 13 illustrates that a time at which the normalized ink pressure is 0.75 is set as time t32 of the trailing edge of the expansion pulse P31, and a time at which the normalized ink pressure is 1.3 is set as time t35 of the leading edge of the second contraction pulse P34. In contrast, in FIG. 26 illustrating a modified example, a time at which the normalized ink pressure is 0.75 which is equal to that in FIG. 13 is set as time t32 of the trailing edge of the expansion pulse P31. However, because time t35 is advanced, a time at which the normalized ink pressure is 1.0 lower than that in FIG. 13 is set as time t35 of the leading edge of the second contraction pulse P34. Even with this 3-drop waveform, it is possible to continuously discharge three ink droplets from the nozzle 301. Further, in this 3-drop waveform, the flow velocity of the third ink droplet is decreased.

Figure 27:
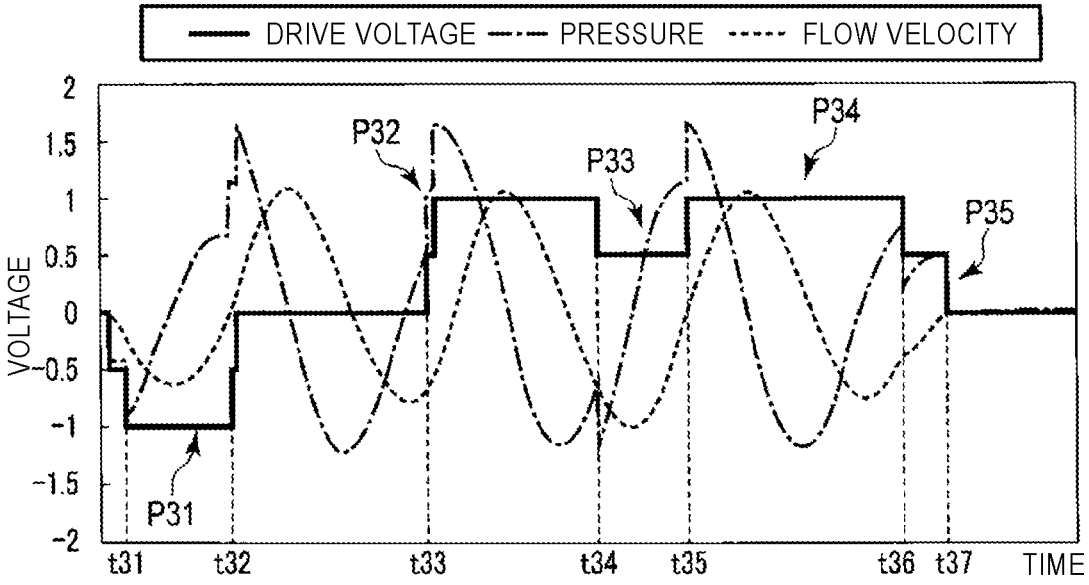
FIG. 27 depicts a drive voltage of a 3-drop waveform and simulated values of an ink pressure and an ink flow velocity when a first contraction pulse of the 3-drop waveform is applied at an earlier timing than in FIG. 12.

FIG. 27 depicts a drive voltage of a 3-drop waveform and simulated values of an ink pressure and an ink flow velocity. In FIG. 27, time t33 of the leading edge of the first contraction pulse P32 from the 3-drop waveform illustrated in FIG. 12. In FIG. 27, the drive voltage waveform is indicated by the solid line, the ink pressure waveform is indicated by the dot dashed line, and the ink flow velocity waveform is indicated by the dashed line. In addition, values on a vertical axis are arbitrarily normalized.

In this example, while a time at which the normalized ink pressure is 0.75, which is equal to that in FIG. 13 is set as time t32 of the trailing edge of the expansion pulse P31, a time at which the normalized ink pressure is 0.5 lower than that in FIG. 13 is set as time t33 of the leading edge of the first contraction pulse P32 by advancing time t33. Further, time t34 of the trailing edge of the first contraction pulse P32 is delayed, thereby decreasing a peak of negative pressure. Therefore, it is possible to reduce positive pressure applied to the adjacent channels, and prevent bubbles from being formed in the pressure chamber 131 by negative pressure. In this 3-drop waveform, a discharge velocity of the second ink droplet is decreased, but even with this 3-drop waveform, it is possible to continuously discharge two ink droplets from the nozzle 301.

In the example embodiments described herein, as illustrated in FIGS. 11 and 13, contraction percentages of the weak contraction pulses P23, P33, and P35 are 50% when contraction percentages of the contraction pulses P22, P32, and P34 are 100%. If the contraction percentages of the weak contraction pulses P23, P33, and P35 are 50%, there is an advantage in that a driving power source is simplified. However, the present disclosure is not limited to the example.

Figure 28:
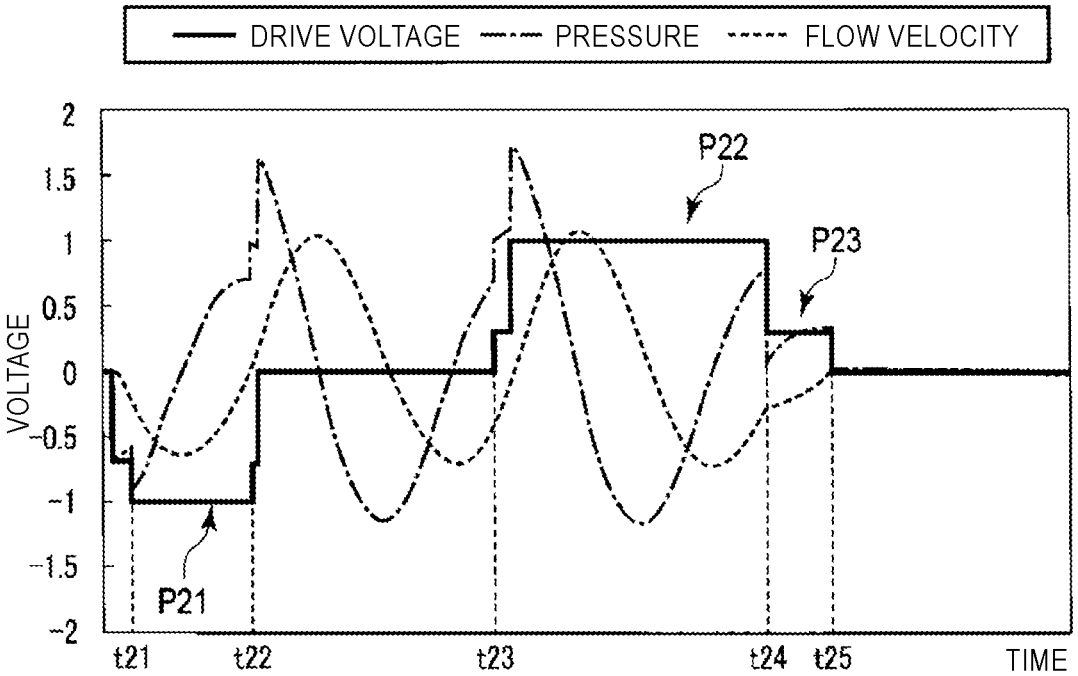
FIG. 28 depicts a drive voltage of a 2-drop waveform and simulated results of an ink pressure and an ink flow velocity when a contraction percentage of the weak contraction pulse of the 2-drop waveform illustrated in FIG. 10 is changed.

FIG. 28 depicts simulated results of an ink pressure and an ink flow velocity when in the 2-drop waveform illustrated in FIG. 10 a contraction percentage of the weak contraction pulse P23 is 30% and a contraction percentage of the contraction pulse P22 is 100%. Even with this 2-drop waveform, one ink droplet is discharged from the nozzle 301 because positive pressure is applied to the ink by a pulse change in the state in which the ink pressure is positive pressure equal to or higher than a threshold value at times t22 and t23. At time t25, a magnitude of amplitude of the ink pressure is equal to negative pressure instantaneously applied to the ink by the trailing edge of the weak contraction pulse P23, and the ink flow velocity becomes zero. Therefore, residual vibration in the pressure chamber 131 is cancelled.

The configuration of the inkjet head 1 is not limited to the configuration described with reference to FIGS. 1 to 6. For example, an inkjet head, which has one piezoelectric member for each pressure chamber, may be applied, or an inkjet head in which electric potential of one of a pair of electrodes of a piezoelectric member is fixed and a drive waveform is applied to the other electrode may be applied. Alternatively, there may be applied a shared wall type inkjet head in which all of the first and second grooves 131 and 132 are defined as pressure chambers to be filled with the ink, and three sets of the pressure chambers are separately operated in every second set.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head, comprising:

a pressure chamber connected to a nozzle;

an actuator corresponding to the pressure chamber and configured to change a volume of the pressure chamber; and a drive circuit configured to drive the actuator, wherein the drive circuit comprises:

a first waveform setting unit configured to provide a first drive waveform unit for causing a single ink droplet to be discharged from the nozzle;

a second waveform setting unit configured to provide a second drive waveform unit for causing two ink droplets to be consecutively discharged from the nozzle;

a first drive waveform generating unit configured to generate a first drive waveform signal by selecting one or more of the first or second waveform units, and then outputting the selected one or more of the first or second waveform units to the actuator in series with each other when more than one is selected for forming a pixel; and a waveform selecting unit configured to select whether the generated first drive waveform signal is applied to the actuator or not based on printing data.

2. The inkjet head according to claim 1, wherein the first drive waveform generating unit generates the first drive waveform signal by selecting at least two first waveform units from the first drive waveform unit and at least one second waveform unit from the second drive waveform unit and outputs the selected at least two first waveform units in sequence with the selected at least one second waveform unit.

3. The inkjet head according to claim 1, wherein a duration of the second drive waveform unit is less than a total duration of two consecutive first drive waveform units.

4. The inkjet head according to claim 1, wherein the drive circuit further comprises a third waveform setting unit configured to provide a third drive waveform unit for causing three ink droplets to be consecutively discharged from the nozzle.

5. The inkjet head according to claim 1, wherein the drive circuit further comprises:

a third waveform setting unit configured to provide a third drive waveform unit for causing a single ink droplet to be discharged from the nozzle;

a fourth waveform setting unit configured to provide a fourth drive waveform unit for causing two droplets to be consecutively discharged from the nozzle; and a second drive waveform generating unit configured to generate a second drive waveform signal by selecting one or more of the third or fourth waveform units, and then outputting the selected one or more of the third or fourth waveform units in series with each other when more than one is selected.

6. The inkjet head according to claim 5, wherein the first drive waveform signal is applied to a first electrode of the actuator and the second drive waveform signal is applied to a second electrode of the actuator.

* * * * *